US010871739B2

(12) United States Patent
Yokoya et al.

(10) Patent No.: US 10,871,739 B2
(45) Date of Patent: Dec. 22, 2020

(54) IMAGE FORMING SYSTEM, CONTROL METHOD THEREOF, AND NON-TRANSITORY COMPUTER-READABLE STORAGE MEDIUM

(71) Applicant: CANON KABUSHIKI KAISHA, Tokyo (JP)

(72) Inventors: Takashi Yokoya, Yoshikawa (JP); Akinobu Nishikata, Matsudo (JP); Yutaka Ando, Toride (JP); Akihiro Arai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 184 days.

(21) Appl. No.: 16/051,867

(22) Filed: Aug. 1, 2018

(65) Prior Publication Data

US 2019/0049892 A1 Feb. 14, 2019

(30) Foreign Application Priority Data

Aug. 9, 2017 (JP) ..... 2017-154730

(51) Int. Cl.
*G03G 15/00* (2006.01)
*G03G 21/20* (2006.01)

(52) U.S. Cl.
CPC ..... *G03G 15/70* (2013.01); *G03G 15/5029* (2013.01); *G03G 15/6558* (2013.01); *G03G 21/203* (2013.01)

(58) Field of Classification Search
CPC ..... G03G 15/70
USPC ..... 399/21
See application file for complete search history.

(56) References Cited

U.S. PATENT DOCUMENTS 6,751,426 B2 6/2004 Akiba et al.
7,877,056 B2 * 1/2011 Yokoya ..... G03G 15/6511 399/407
7,920,820 B2 * 4/2011 Kitta ..... B42C 9/0025 270/58.08
8,038,139 B2 10/2011 Nishimura et al.
8,157,255 B2 4/2012 Nishimura et al.
8,364,050 B2 * 1/2013 Yasukawa ..... G03G 15/5012 399/18
2009/0315246 A1 * 12/2009 Nishimura ..... B42C 1/12 271/3.14
2010/0284721 A1 * 11/2010 Nakamura ..... G03G 15/6541 399/407

(Continued)

FOREIGN PATENT DOCUMENTS

JP 2003-221160 A 8/2003

*Primary Examiner* — Anthony H Nguyen
(74) *Attorney, Agent, or Firm* — Venable LLP

(57) ABSTRACT

An image forming system includes an image forming unit configured to form an image on a recording medium; a feeding unit on which the recording medium is placed and configured to convey the recording medium toward the image forming unit on a conveyance path; an insert unit on which an insert sheet is placed and configured to convey the insert sheet so as to insert the insert sheet between a plurality of recording mediums conveyed from the image forming unit; a storage unit configured to store information concerning feeding of the recording medium; and a control unit configured to control a feeding timing of the insert sheet by the insert unit based on the information stored in the storage unit.

12 Claims, 25 Drawing Sheets

(56) References Cited

U.S. PATENT DOCUMENTS

| | | | | |
|---|---|---|---|---|
| 2016/0202651 | A1* | 7/2016 | Yamada | G03G 15/50 399/382 |
| 2016/0246550 | A1* | 8/2016 | Taki | G06F 3/1204 |
| 2017/0023901 | A1* | 1/2017 | Asakawa | G03G 15/5012 |
| 2018/0152573 | A1* | 5/2018 | Taki | H04N 1/32641 |
| 2018/0348689 | A1 | 12/2018 | Ando et al. | |

* cited by examiner

FIG. 6

| SHAPE | SURFACE PROPERTY | BASIS WEIGHT | | | | | | | | |
|---|---|---|---|---|---|---|---|---|---|---|
| | | 80~150 | | | 151~256 | | | 257~350 | | |
| | | LL | NL | HH | LL | NL | HH | LL | NL | HH |
| NORMAL | WOOD FREE PAPER | 0 | 0 | 0 | 0 | 0 | 0 | 0 | 0 | 0 |
| | RECYCLED PAPER | 0 | 0 | 0 | — | — | — | — | — | — |
| | COATED PAPER | 0 | 0 | 0 | 0 | 0 | 0 | 0 | 0 | 0 |
| | MATT COATED PAPER | 0 | 0 | 0 | 0 | 0 | 0 | 0 | 0 | 0 |
| | EMBOSSED PAPER | 0 | 0 | 0 | 0 | 0 | 0 | 0 | 0 | 0 |
| | VELLUM PAPER | 0 | 0 | 0 | — | — | — | — | — | — |
| | OHP | — | — | — | FOUR TIMES | FOUR TIMES | FOUR TIMES | — | — | — |
| | LABEL | — | — | — | 0 | 0 | 0 | — | — | — |
| | POSTCARD | — | — | — | 0 | 0 | 0 | — | — | — |
| TAB PAPER | WOOD FREE PAPER | — | — | — | 0 | 0 | 0 | — | — | — |
| PUNCHED PAPER | WOOD FREE PAPER | 0 | 0 | TWO TIMES | — | — | — | — | — | — |

| BRAND | FEEDING CONTROL MODE |
|---|---|
| PLAIN PAPER FROM COMPANY A | SNAP DECISION MODE |
| PLAIN PAPER FROM COMPANY B | SNAP DECISION MODE |
| PLAIN PAPER FROM COMPANY C | SNAP DECISION MODE |
| TRANSLUCENT PAPER FROM COMPANY A | TRANSFER SHEET DECISION MODE |
| TRANSLUCENT PAPER FROM COMPANY B | SNAP DECISION MODE |
| TRANSLUCENT PAPER FROM COMPANY C | SNAP DECISION MODE |

FIG. 16

| FEEDING STAGE NO. | LATEST FEEDING STATUS |
|---|---|
| FEEDING STAGE 1 | SUCCESS |
| FEEDING STAGE 2 | SUCCESS |
| FEEDING STAGE 3 | FAILURE |
| FEEDING STAGE 4 | SUCCESS |
| FEEDING STAGE 5 | NOT FEED |
| ••• | ••• |

FIG. 18

| FEEDING STAGE NO. | FEEDING SUCCESS COUNTER |
|---|---|
| FEEDING STAGE 1 | 120 TIMES |
| FEEDING STAGE 2 | 35 TIMES |
| FEEDING STAGE 3 | 0 |
| FEEDING STAGE 4 | 75 TIMES |
| FEEDING STAGE 5 | 0 |
| ••• | ••• |

IMAGE FORMING SYSTEM, CONTROL METHOD THEREOF, AND NON-TRANSITORY COMPUTER-READABLE STORAGE MEDIUM

BACKGROUND OF THE INVENTION

Field of the Invention

The present invention relates to an image forming system, a control method thereof, and a non-transitory computer-readable storage medium.

Description of the Related Art

There is available a system including an insert unit on which insert sheets are stacked and which inserts an insert sheet between a plurality of transfer sheets on which images are formed. Such a system employs a method of feeding transfer sheets after the presence of an insert sheet is decided from the immediately preceding insert unit when the number of stacked insert sheets becomes small (Japanese Patent Laid-Open No. 2003-221160). According to this method, the transfer sheets are fed in snap decision to maintain a high productivity when the number of stacked insert sheets is large, while the discharge of defective products caused by sudden absence of insert sheets can be prevented when the number of stacked insert sheets becomes small.

On the market, various types of sheets are available, including media which tend to jam or tend not to jam even if these media are the same type. For example, a translucent sheet available from company A can be properly detected by a sensor in a conveyance path, but a translucent sheet available from company B may be detected or not detected depending on the case. This may occur because the manufacturing processes and the components and transparencies of the sheets between the companies are different from each other. In addition, jam tends to occur in the same type of sheets available from the company A depending on the sheet storage environment for each user. In this manner, various kinds of factors by which jam occurs in the image forming apparatus are present in a wide range.

When feeding the insert sheet from the insert unit described above, the insert sheet is fed without waiting the success of feeding the transfer sheet serving as a sheet (immediately preceding sheet) located at the immediately preceding position of the insert sheet (this feeding control will be referred to as a "snap decision mode" hereinafter). In this case, the insert sheet is guided to the conveyance path from the insert unit by a predetermined distance. On the other hand, in a feeding stage on which transfer sheets are stacked, particularly after the replenishment of transfer sheets, the jam may occur at the time of feeding due to a setting error by a user or an external factor. In the snap decision mode, after the insert sheet is guided into the conveyance path from the insert unit, if jam of a transfer sheet which should be a preceding sheet occurs, the insert sheet which has been guided into the conveyance path cannot be discharged and remains inside the apparatus. This is because the order of pages of the product becomes wrong if the insert sheet is forcibly discharged. This insert sheet can be used after the restoration from the jam processing while being left in the apparatus. If the user erroneously removes the insert sheet at the time of jam processing, the order of pages of the product becomes wrong in the same manner as described above. If jam of the transfer sheet occurs in the snap decision mode, the number of sheets remaining in the apparatus at the time of jam increases, and the jam processing is degraded.

In order to prevent this, there is available a control method of starting feeding of the insert sheet until the success of feeding the transfer sheet serving as the immediately preceding sheet (this feeding control will be referred to as a "transfer sheet decision mode" hereinafter). Until the insert sheet is actually fed, there are conveyance delays due to the feeding preparation time, the sheet stop/conveyance operation for removing a skewed sheet, and a low conveyance speed of the insert unit with respect to the image forming apparatus. For this reason, if it is judged to feed the succeeding insert sheet immediately after the feeding success of the transfer sheet is decided, the distance between the sheets increases to degrade the productivity.

SUMMARY OF THE INVENTION

The present invention can control the timing of inserting an insert sheet appropriately in consideration of the effect and problem of each mode for inserting the insert sheet.

According to one aspect of the present invention, there is provided an image forming system comprising: an image forming unit configured to form an image on a recording medium; a feeding unit on which the recording medium is placed and configured to convey the recording medium toward the image forming unit on a conveyance path; an insert unit on which an insert sheet is placed and configured to convey the insert sheet so as to insert the insert sheet between a plurality of recording mediums conveyed from the image forming unit; a storage unit configured to store information concerning feeding of the recording medium; and a control unit configured to control a feeding timing of the insert sheet by the insert unit based on the information stored in the storage unit.

According to another aspect of the present invention, there is provided a control method for an image forming system including: an image forming unit configured to form an image on a recording medium; a feeding unit on which the recording medium is placed and configured to convey the recording medium toward the image forming unit on a conveyance path; an insert unit on which an insert sheet is placed and configured to convey the insert sheet so as to insert the insert sheet between a plurality of recording mediums conveyed from the image forming unit; and a storage unit configured to store information concerning feeding of the recording medium, the method comprising controlling a feeding timing of the insert sheet by the insert unit based on the information stored in the storage unit.

According to another aspect of the present invention, there is provided a non-transitory computer-readable storage medium storing a program for causing an image forming system including: an image forming unit configured to form an image on a recording medium; a feeding unit on which the recording medium is placed and configured to convey the recording medium toward the image forming unit on a conveyance path; an insert unit on which an insert sheet is placed and configured to convey the insert sheet so as to insert the insert sheet between a plurality of recording mediums conveyed from the image forming unit; and a storage unit configured to store information concerning feeding of the recording medium, to function to control a feeding timing of the insert sheet by the insert unit based on the information stored in the storage unit.

By the present invention, the timing of starting to insert the insert sheet is appropriately changed, both the prevention of degradation of the jam processability and the prevention of degradation of productivity at the time of feeding the insert sheet are satisfied.

Further features of the present invention will become apparent from the following description of exemplary embodiments (with reference to the attached drawings).

BRIEF DESCRIPTION OF THE DRAWINGS

FIG. 6 is a view showing an example of an accumulation jam count table according to the first embodiment;

FIG. 16 is a view showing the arrangement example of feeding history information according to the third embodiment;

FIG. 18 is a view showing the arrangement example of feeding history information according to the fourth embodiment;

DESCRIPTION OF THE EMBODIMENTS

First Embodiment

[System Arrangement]

Figure 1:
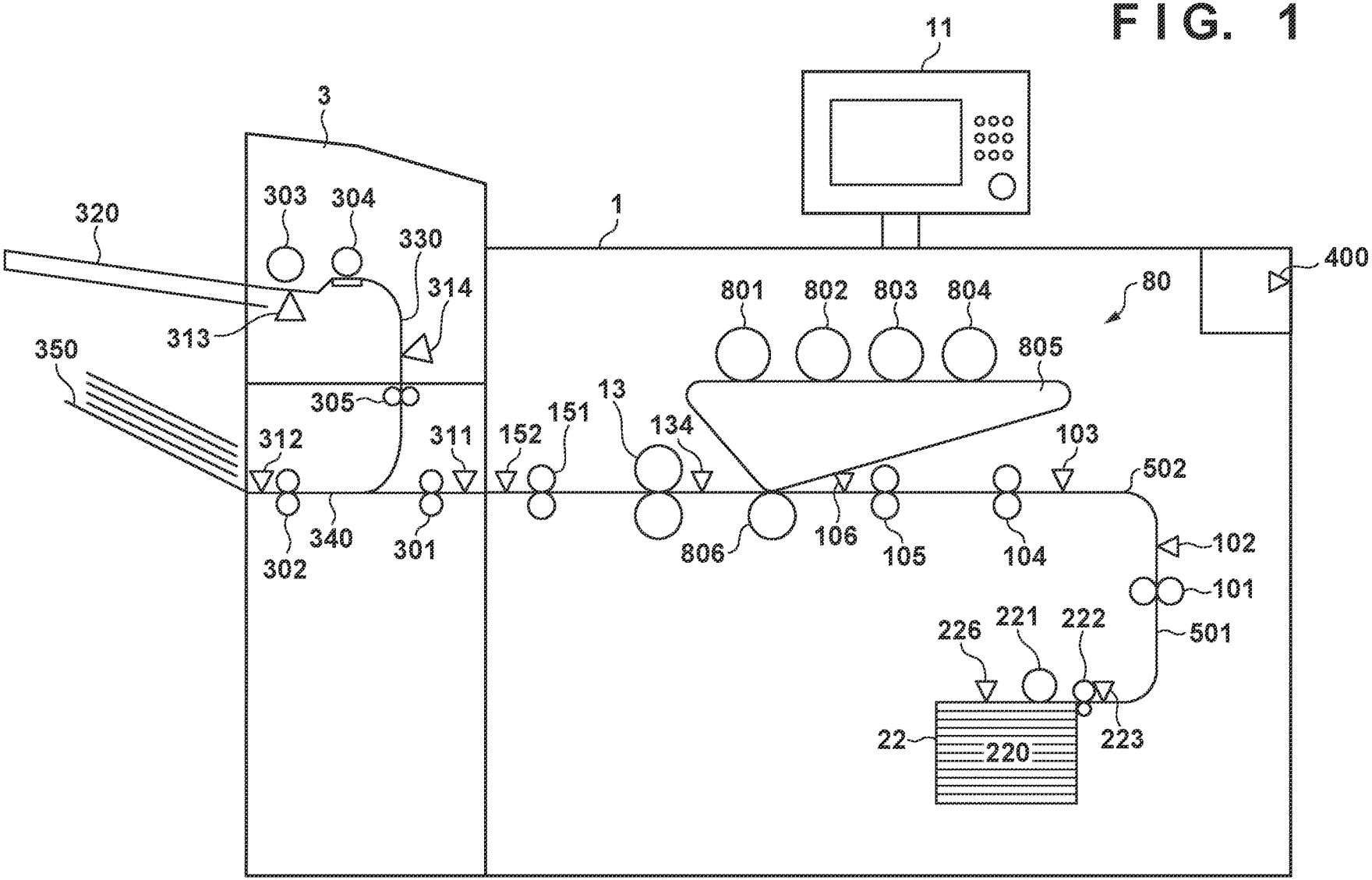
FIG. 1 is a sectional view of an image forming system according to each of the first and second embodiments.

FIG. 1 is a view showing the arrangement example of an image forming system according to the first embodiment of the present invention. The image forming system according to this embodiment includes an image forming apparatus 1 and an insert apparatus 3. The image forming apparatus 1 includes a user interface 11, and a user inputs an instruction corresponding to each kind of function such as a copy function from the user interface 11. When the user inputs the instruction, transfer sheets are fed one by one from a feeding unit 22 which stores a plurality of transfer sheets. The transfer sheet is a recording medium such as paper and placed on a paper storage 220. A lifter motor 202 and a paper surface sensor 226 shown in FIG. 2 control the position of a sheet located at the uppermost position of the paper storage 220 (to be referred to as an uppermost sheet hereinafter) in the paper storage 220 such that the uppermost sheet contacts a pickup roller 221. Note that the type, size, and material of the transfer sheets stored in the paper storage 220 are not limited to the specific ones.

The pickup roller 221 feeds the uppermost sheet in the paper storage 220 to feeding rollers 222. The feeding rollers 222 are formed from the upper and lower rollers. The upper roller rotates in the feeding direction, while the lower roller rotates in the return direction, thereby feeding the transfer sheets one by one.

The image forming apparatus 1 uses a feeding sensor 223 to confirm that the uppermost sheet has been picked up at a predetermined timing. After the start of the pickup, if the output value of the feeding sensor 223 is not turned on upon the elapse of a predetermined time or longer, the image forming apparatus 1 stops upon occurrence of jam (to be referred to as "feeding delay jam" hereinafter). Even if the output value of the feeding sensor 223 is not turned off without passage of the trailing edge of the transfer sheet with the elapse of the predetermined time or longer after the output value of the feeding sensor 223 is turned on, the image forming apparatus 1 stops upon occurrence of jam (to be referred to as "feeding stay jam" hereinafter). In the following description, the feeding delay jam and the feeding stay jam will be called "feeding jam" together.

The transfer sheet passing through the feeding rollers 222 is conveyed to a vertical path 501. The transfer sheet passing through a path sensor 102 by vertical path rollers 101 is guided to a horizontal path 502. An image is transferred to the transfer sheet in an image forming unit 80 including drums 801 to 804, an intermediate transfer member 805, and a secondary transfer unit 806. In this case, an arrangement including the four drums 801 to 804 corresponding to the four colors is exemplified, but the number of drums is not limited to this.

The image forming apparatus 1 aligns the image of the image forming unit 80 with the leading edge of the transfer sheet on the horizontal path 502 by using a pre-registration sensor 103, pre-registration rollers 104, registration rollers 105, and a registration sensor 106. As for the alignment of the image with the leading edge of the transfer sheet, an arrangement for driving the registration rollers 105 based on an image formation synchronization signal is known well.

The image transferred to the transfer sheet is fixed by pressure and heating by causing the transfer sheet to pass through a fixing unit 13. The transfer sheet on which the image is fixed is conveyed toward the insert apparatus 3 by discharge rollers 151. A discharge sensor 152 confirms whether transfer of the transfer sheet to the insert apparatus 3 is completed at a predetermined timing. If the target transfer sheet remains even after the predetermined timing, conveyance is stopped as the feeding stay jam.

A temperature/humidity sensor 400 is attached to the outer portion of the image forming apparatus 1. This makes it possible to measure the temperature and humidity in the surroundings of the apparatus. A CPU 901 decides an environment section around the apparatus from the temperature and humidity detected by the temperature/humidity sensor 400. In this embodiment, the environment sections are classified into three sections, that is, a "low-temperature low-humidity environment" (to be referred to as an LL environment hereinafter), an "intermediate-temperature low-humidity environment" (to be referred to as an NL environment hereinafter), and a "high-temperature high-humidity environment" (to be referred to as an HH environment hereinafter). The number of environment sections is merely an example. A larger number of environment sections may be defined in accordance with, for example, combinations of temperatures and humidities. In addition, the sensor used here is not limited to a sensor capable of detecting both the temperature and the humidity, but can be a sensor for detecting one of the temperature and the humidity.

The transfer sheet on which the image is transferred and fixed by the image forming apparatus 1 is transferred to the insert apparatus 3 via the discharge rollers 151. The transfer sheet discharged from the image forming apparatus 1 is fed to the insert apparatus 3. When the transfer sheet is detected by a path sensor 311 of the insert apparatus 3, inlet rollers 301 are driven to convey the transfer sheet toward a horizontal path 340. When the transfer sheet passes through discharge rollers 302, the transfer sheet is discharged toward a discharge tray 350 of the insert apparatus 3 directly. In the arrangement of FIG. 1, the transfer sheet is conveyed on the conveyance path made from the vertical path 501 and the horizontal path 502 in the image forming apparatus 1 and the horizontal path 340 of the insert apparatus 3 and then discharged. A discharge sensor 312 is a sensor for detecting whether the transfer sheet is normally discharged to the discharge tray 350.

Driving (conveyance) for the transfer sheet on which the image is formed by the image forming apparatus 1 has been described above. A drive system for conveying an insert sheet fed from a feeding tray 320 of the insert apparatus 3 will now be described.

The insert apparatus 3 includes the feeding tray 320 for stacking, feeding, and conveying the insert sheet. A sheet located at the uppermost position among the sheets (insert sheets) stacked on the feeding tray 320 is conveyed downstream by a feeding roller 303. Only one insert sheet is reliably conveyed to a conveyance path 330 by a separation roller 304. The insert sheet guided to the conveyance path 330 is conveyed from a registration sensor 314 by a predetermined amount, and the leading edge of the insert sheet abuts against stopped registration rollers 305. The insert sheet is temporarily stopped in a state in which a loop is formed, thereby correcting the skew of the insert sheet which has occurred during the feeding and conveying operation.

When the leading edge of the insert sheet abuts against the registration rollers 305, and the insert sheet is stopped for a predetermined time, the separation roller 304, the registration rollers 305, and the discharge rollers 302 are driven, and the insert sheet is discharged to the discharge tray 350 via the joining portion between the conveyance path 330 and the horizontal path 340.

(Image Forming Apparatus)

Figure 2:
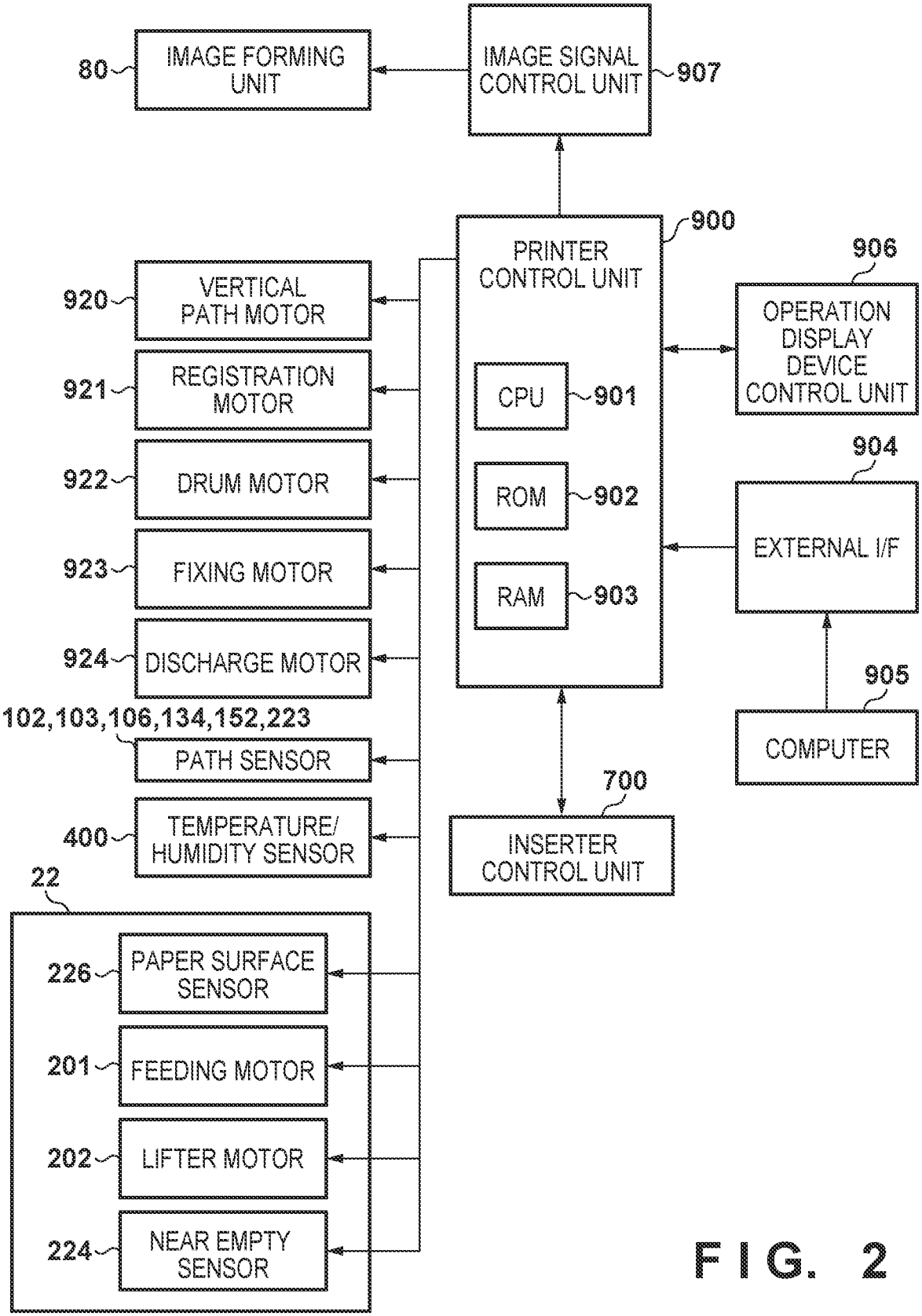
FIG. 2 is a block diagram of the image forming system according to each of the first and second embodiments.

FIG. 2 is a view showing the arrangement example of the controller for controlling the entire image forming apparatus 1 and its peripheral portion according to this embodiment.

The controller includes a printer control unit 900. The printer control unit 900 incorporates the CPU 901, a ROM 902, and a RAM 903. The CPU 901 reads out a control program stored in the ROM 902 and executes it to comprehensively control an image signal control unit 907, an operation display device control unit 906, and the image forming apparatus 1. The RAM 903 temporarily holds control data and is used as the work area of arithmetic processing accompanying control.

The image signal control unit 907 performs various kinds of processing on a digital image signal input from a computer 905 as an external apparatus via an external I/F 904, converts this digital image signal into a video signal, and outputs the video signal to the image forming unit 80.

The operation display device control unit 906 controls the user interface 11 shown in FIG. 1 and exchanges information with the printer control unit 900 in order to perform display output and instruction input. The user interface 11 includes a plurality of keys for setting various functions concerning image formation and a display unit for displaying information indicating the set state. In addition, the user interface 11 outputs a key signal corresponding to the operation of each key to the printer control unit 900 and displays, on the display unit, the corresponding information based on the signal from the printer control unit 900.

The main sheet conveyance drive system of the image forming apparatus 1 according to this embodiment will be described next with reference to FIGS. 1 and 2.

As the drive sources from the feeding unit 22 to the vertical path 501, the image forming apparatus 1 includes a feeding motor 201 for driving the pickup roller 221, and a vertical path motor 920 for driving the feeding rollers 222 and the vertical path rollers 101. The feeding unit 22 includes a near empty sensor 224 for detecting that the remaining amount of the transfer sheets placed on the paper storage 220 is smaller than a predetermined amount.

As the drive sources from the horizontal path 502 to the transfer unit, the image forming apparatus 1 includes the pre-registration rollers 104 and a registration motor 921 for driving the registration rollers 105. As the drive sources from the transfer unit to the discharge unit (the joining portion with the insert apparatus 3), the image forming apparatus 1 includes a drum motor 922 for driving the drums 801 to 804, the intermediate transfer member 805, and the secondary transfer unit 806 in the image forming unit 80, a fixing motor 923 for driving the fixing unit 13, and a discharge motor 924 for driving the discharge rollers 151. In addition, the image forming apparatus 1 includes detection sensors such as the path sensors 102, 103, 106, 152, and 223, and a path sensor 134 to detect passage of a sheet.

The transfer sheet passing through the discharge rollers 151 is transferred to the insert apparatus 3. The printer control unit 900 exchanges data with an inserter control unit 700 arranged on the side of the insert apparatus 3 to perform conveyance control. That is, the printer control unit 900 and the inserter control unit 700 cooperate to control a series of conveyance operations of each sheet.

(Insert Apparatus)

Figure 3:
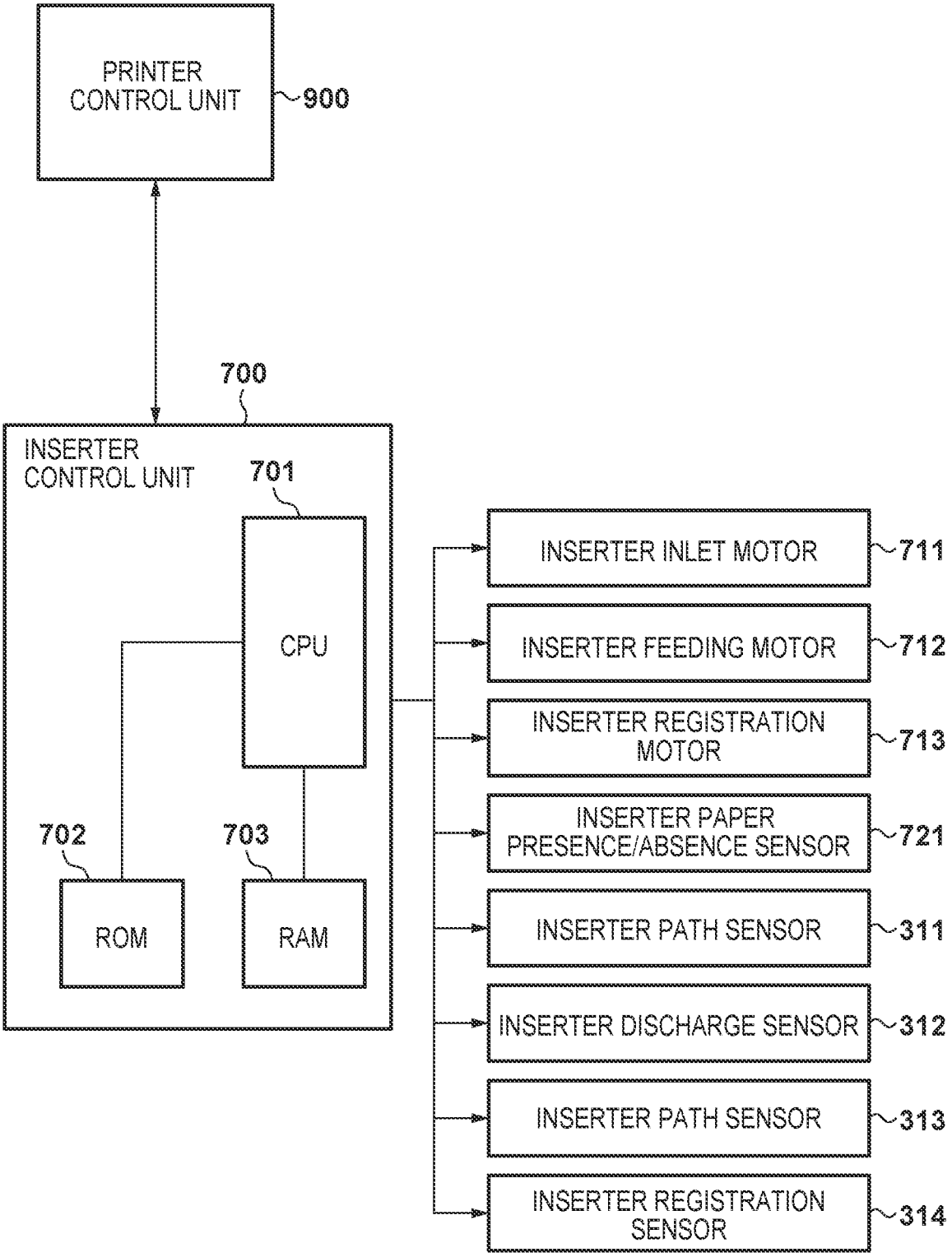
FIG. 3 is a block diagram of an inserter control unit according to the present invention.

FIG. 3 is a view showing the arrangement example of the inserter control unit 700 of the insert apparatus 3 and its peripheral unit according to this embodiment.

The inserter control unit 700 incorporates a CPU 701, a ROM 702, and a RAM 703. The CPU 701 reads out a control program stored in the ROM 702 and executes it to control the insert apparatus 3. The RAM 703 temporarily holds control data and is used as a work area for arithmetic processing accompanying control.

The main sheet conveyance drive system of the insert apparatus 3 will be described next with reference to FIGS. 1 and 3.

The insert apparatus 3 includes an inserter inlet motor 711 for driving the inlet rollers 301 and the discharge rollers 302 as the drive source for receiving the transfer sheet conveyed from the image forming apparatus 1 and conveying the transfer sheet toward the discharge tray 350. As the drive source for feeding the sheet to the insert apparatus 3 and performing skew correction on the conveyance path 330, the insert apparatus 3 includes an inserter feeding motor 712 for driving the separation roller 304 and the feeding roller 303 for feeding the insert sheet.

The insert apparatus 3 includes an inserter registration motor 713 for driving the registration rollers 305 as the drive source for conveying the insert sheet from the image forming apparatus 1 to the joining portion after the skew of the insert sheet fed from the feeding tray 320 is removed. The feeding tray 320 includes an inserter paper presence/absence sensor 721 and can detect whether the sheet is placed on the feeding tray 320.

Note that when the insert apparatus 3 continuously feeds insert sheets during a job after a plurality of insert sheets are set, the insert apparatus 3 performs skew correction using the registration rollers 305 set in the stop state. After that, the insert apparatus 3 starts conveyance of the insert sheet toward the horizontal path 340 in accordance with an instruction from the printer control unit 900. Once the trailing edge of the insert sheet has passed through the inserter paper presence/absence sensor 721, the insert apparatus 3 can detect the next insert sheet. In addition, in order to detect the passage of the insert sheet, the insert apparatus 3 includes the detection sensors such as the path sensors 311, 312, and 314, and a path sensor 313.

Note that one insert apparatus 3 is illustrated in the arrangement example of FIG. 1, but the present invention is not limited to this. A plurality of insert apparatuses may be connected to each other, or a plurality of feeding trays corresponding to the plurality of types of insert sheets may be arranged.

(Operation Display Device)

Figure 7:
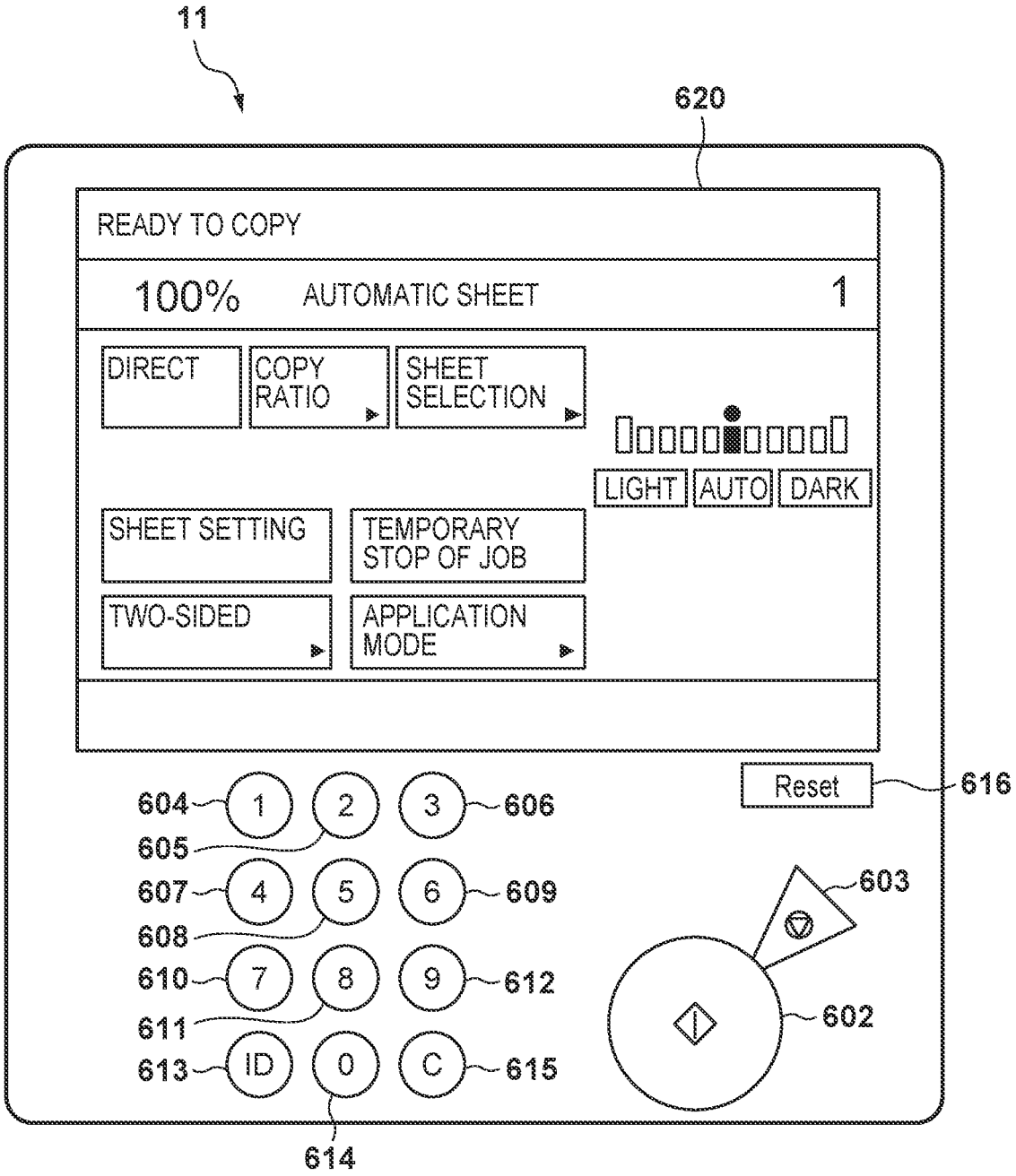
FIG. 7 is a view showing the arrangement example of a user interface.

FIG. 7 is a view showing the arrangement example of the user interface 11 serving as the operation display unit in the image forming apparatus 1 of FIG. 1. The user interface 11 includes a start key 602 for starting an image forming operation, a stop key 603 for interrupting the image forming operation, numerical keys 604 to 612 and 614, an ID key 613, a clear key 615, a reset key 616, and the like. A display unit 620 including a touch panel on the upper portion of the user interface 11 is arranged in the user interface 11, and soft keys can be created on a screen displayed on the display unit 620.

The image forming apparatus 1 according to this embodiment has a function corresponding to the insert sheet as an application mode. Such mode setting can be performed by an input operation from the user interface 11. For example, to set the application mode, when an application mode key 812 as the soft key is selected on the initial screen shown in FIG. 8A, a menu selection screen is displayed on the display unit 620, and the processing mode setting is performed using this menu selection screen.

[Sheet Setting]

When the user sets sheets on the feeding unit 22, pieces of information of the set sheets must be registered using the user interface 11. The sequence of a method of setting the surface property, shape, basis weight, size, and the like will be described below with reference to FIGS. 8A to 8F. Note that the above setting items concerning the sheet are merely examples, and are not limited to these. Other attribute values may be set. In the following description, an example of the screen arrangement in which an item is selected using a button form is illustrated, but the present invention is not limited to this. Each item may be selected in the list form.

Figure 8A:
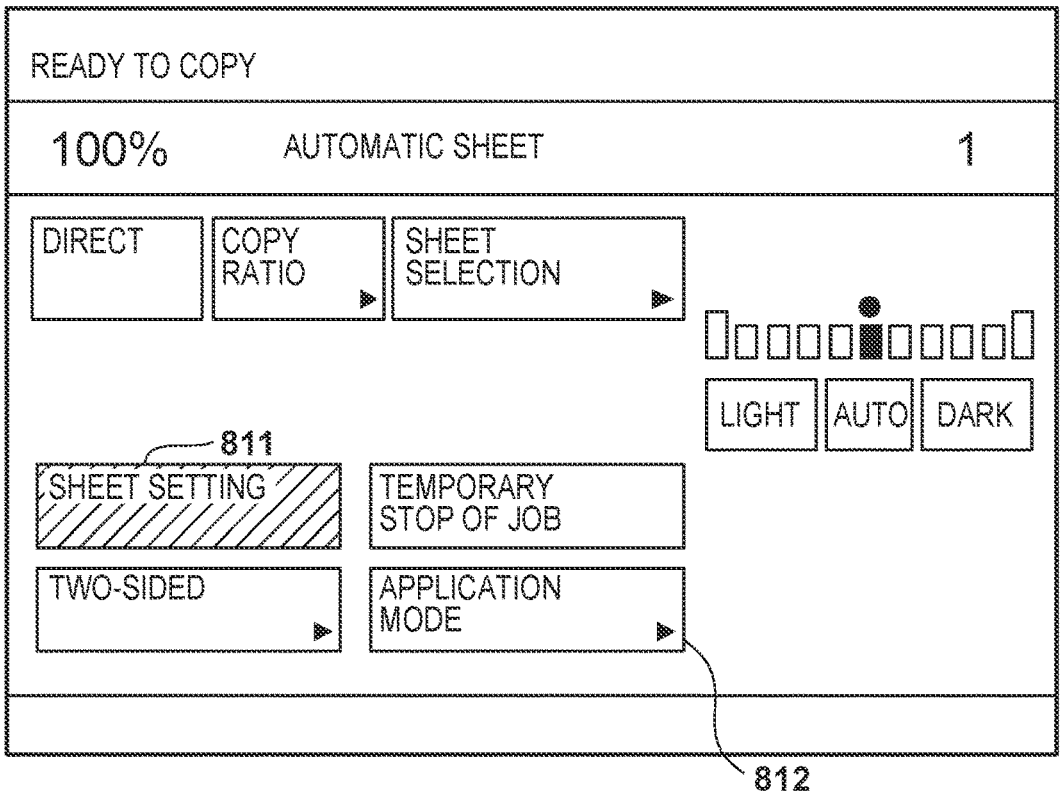
FIGS. 8A, 8B, 8C, 8D, 8E, and 8F are views for explaining a sheet setting sequence according to the first embodiment.
Figure 8B:
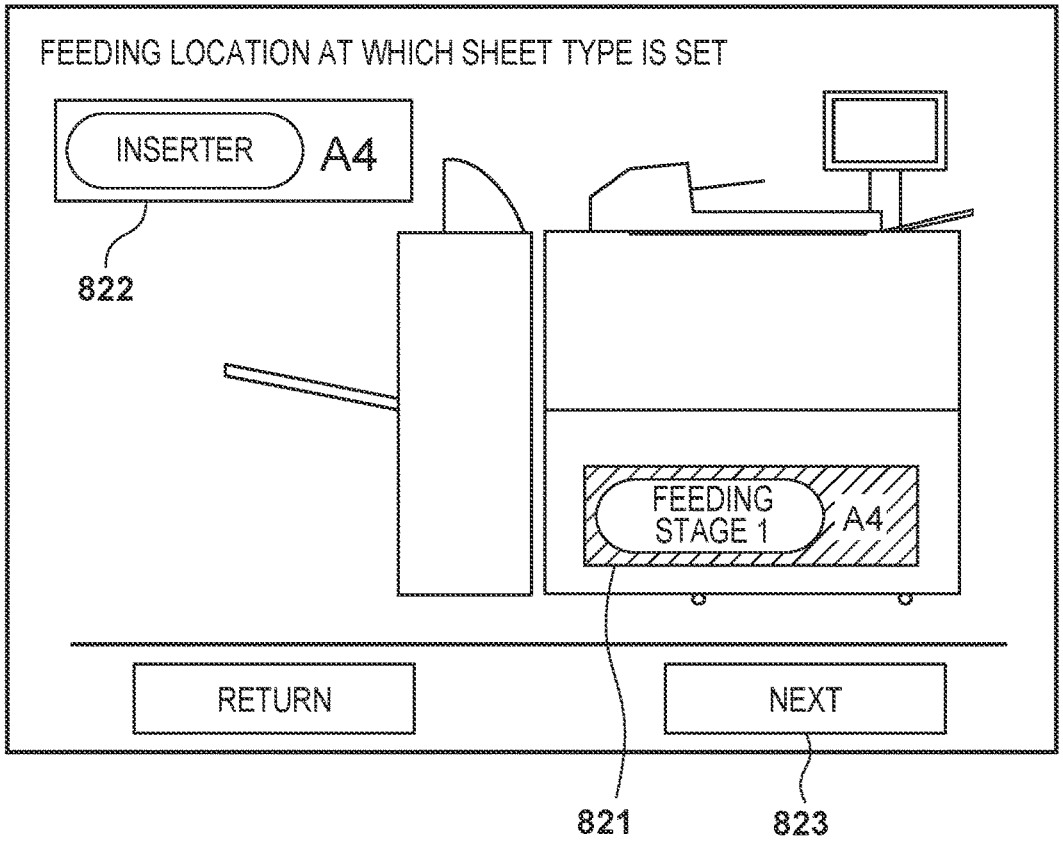

When the user presses a "paper setting" button 811 on the initial screen shown in FIG. 8A, the screen shifts to a sheet setting screen shown in FIG. 8B under the control of the CPU 901.

On the sheet setting screen, whether sheet setting for a sheet stored in a specific sheet storage is performed is selected. The sheet storage is selected from the two sheet storages, that is, the feeding unit 22 (button 821) of the image forming apparatus 1 and the feeding tray 320 (button 822) of the insert apparatus 3. In this case, assume that the selection of the feeding unit 22 (button 821) in which a sheet bundle is set by the user is accepted, and that a "next" button 823 is pressed. When the "next" button 823 is pressed, the screen shifts to a surface property setting screen shown in FIG. 8C under the control of the CPU 901.

Figure 8C:
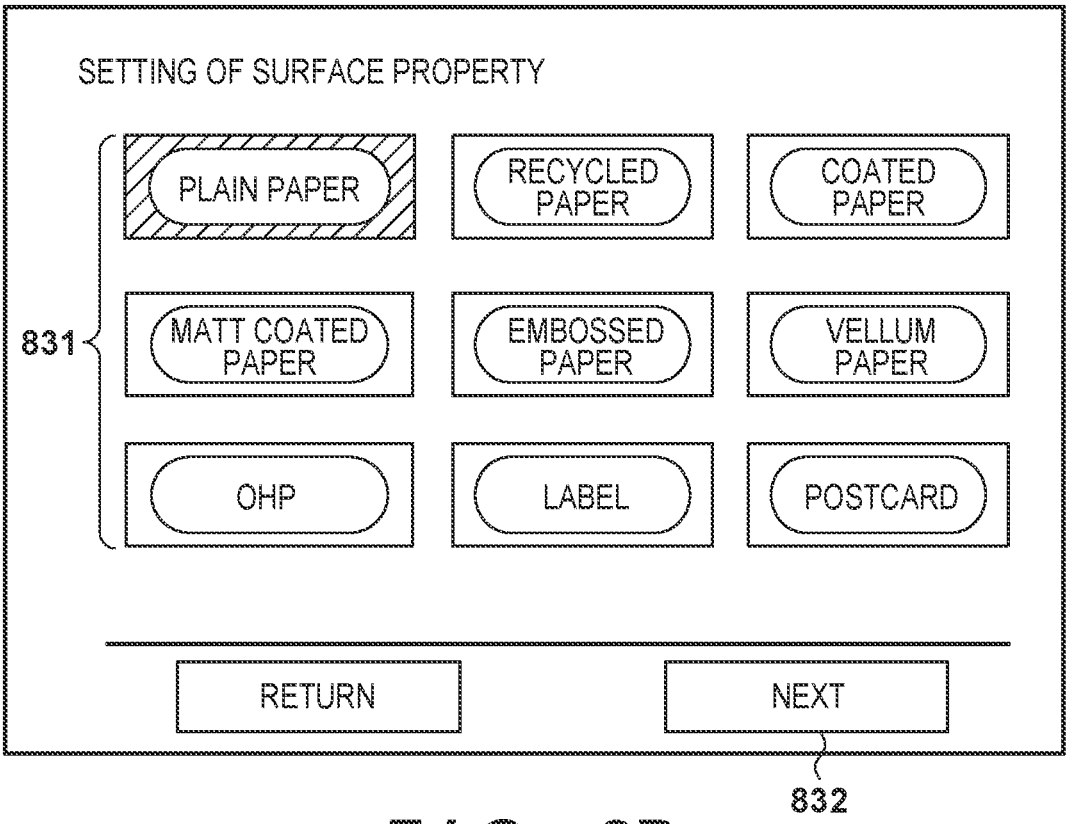

In the surface property setting screen, the surface property of the sheets set in the sheet storage is selected from the set choices (buttons 831), and a "next" button 832 is pressed. The number and types of choices corresponding to the surface properties shown in FIG. 8C are merely examples and are not limited these. In addition, these choices are predetermined. Upon selection of the surface property, when the "next" button 832 is pressed, the screen shifts to a shape setting screen shown in FIG. 8D under the control of the CPU 901.

Figure 8D:
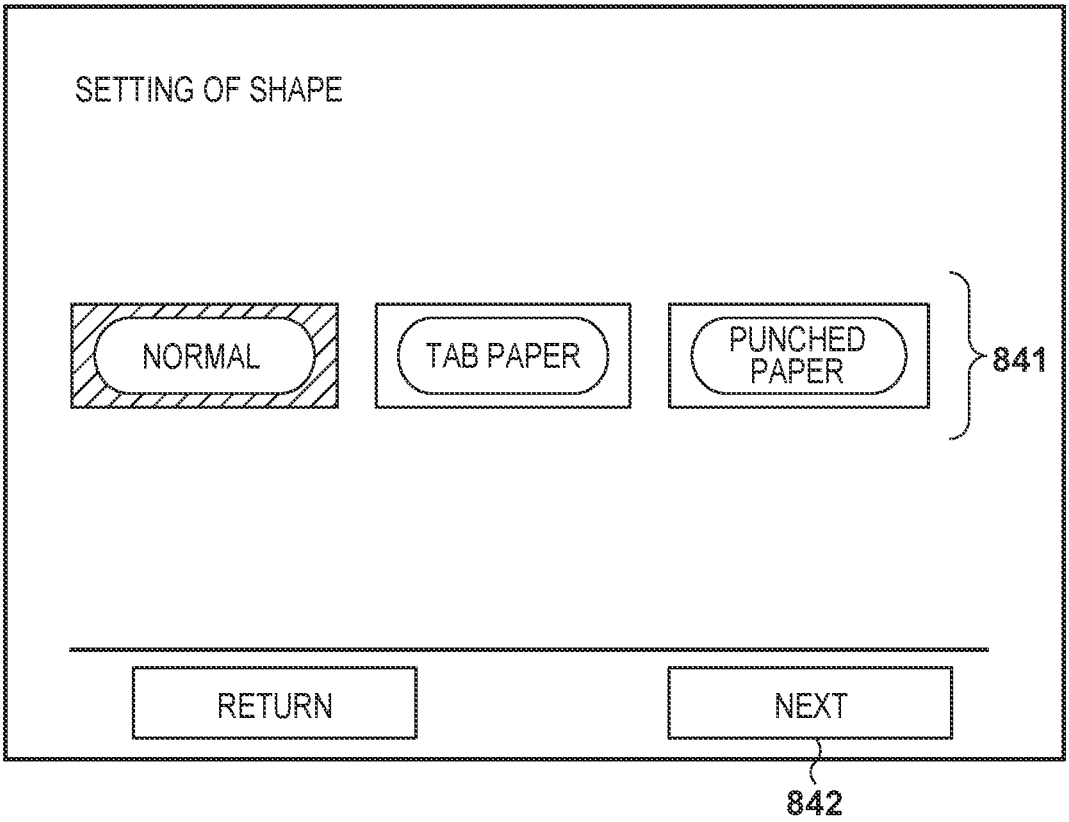

In the shape setting screen, the shape of the sheets set in the sheet storage is selected from the set choices (buttons 841), and a "next" button 842 is pressed. The number and types of choices corresponding to the shapes shown in FIG. 8D are merely examples, and are not limited to these. These choices are predetermined. Upon selection of the shape, when the "next" button 842 is pressed, the screen shifts to a basis weight setting screen shown in FIG. 8E under the control of the CPU 901.

Figure 8E:
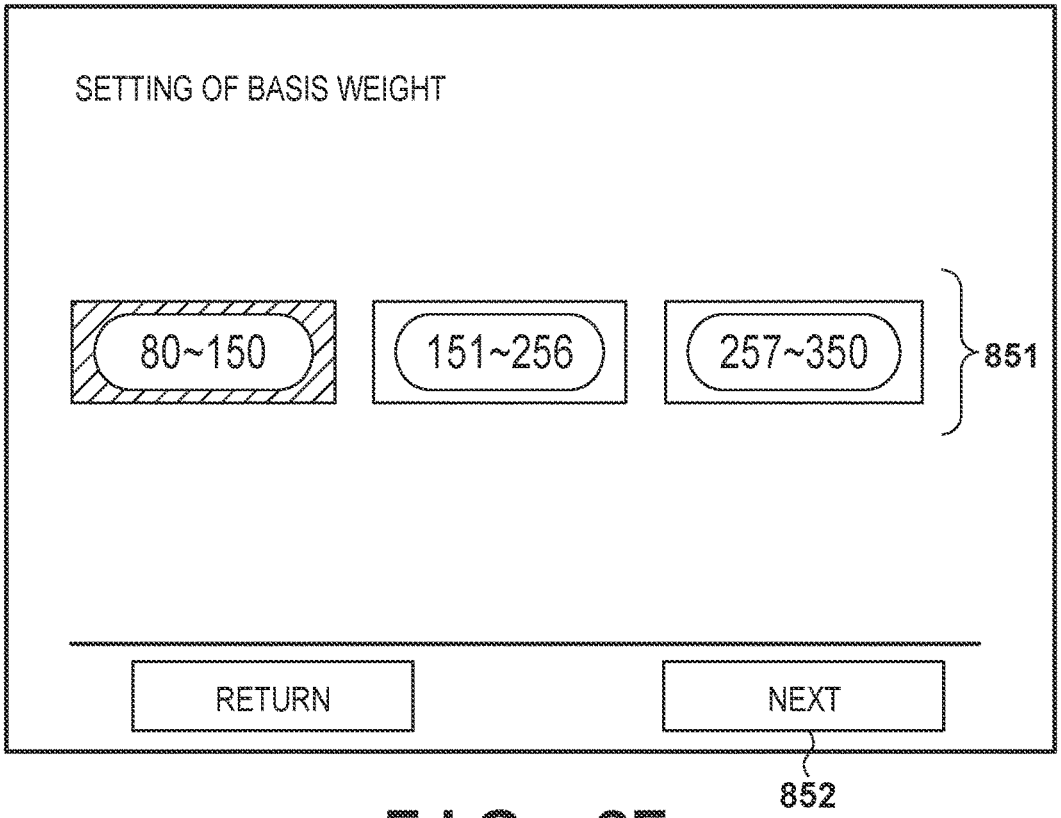

In the basis weight setting screen, the basis weight of the sheets set in the sheet storage is selected from the set choices (buttons 851), and a "next" button 852 is pressed. The number and range of choices corresponding to the basis weights shown in FIG. 8E are merely examples and are not limited to these. These choices are predetermined. Upon selection of the basis weight, when the "next" button 852 is pressed to shift the screen to a sheet size setting screen shown in FIG. 8F.

Figure 8F:
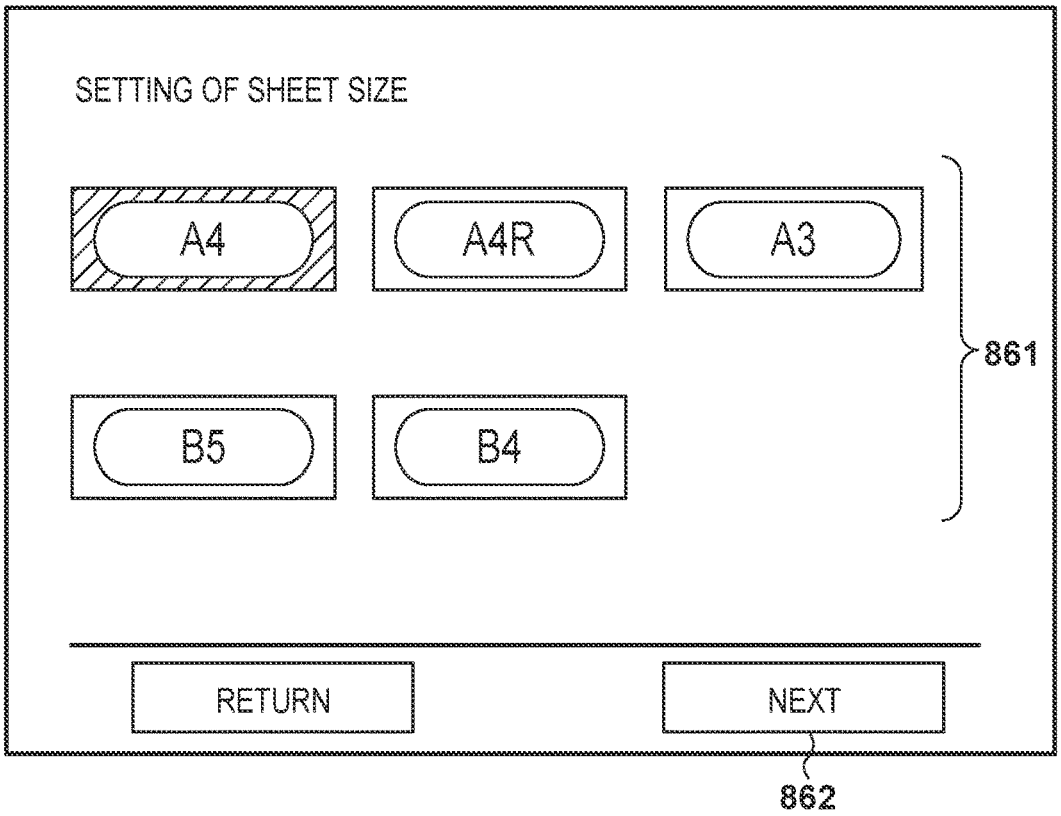

In the sheet size setting screen, the size of the sheets set in the sheet storage is selected from the set choices (buttons 861), and a "next" button 862 is pressed. The number and types of choices corresponding to the basis weights shown in FIG. 8F are merely examples and are not limited to these. These choices are predetermined. Upon selection of the sheet size, when the "next" button 862 is pressed, a series of sheet setting operations is complete.

If a sheet bundle is set in the insert apparatus 3 (if the button 822 in FIG. 8B is selected) as well, the sheet settings ad sheet registration are performed in accordance with the above sequence.

[Insert Sheet Insertion in Transfer Sheet Decision Mode]

Figure 4:
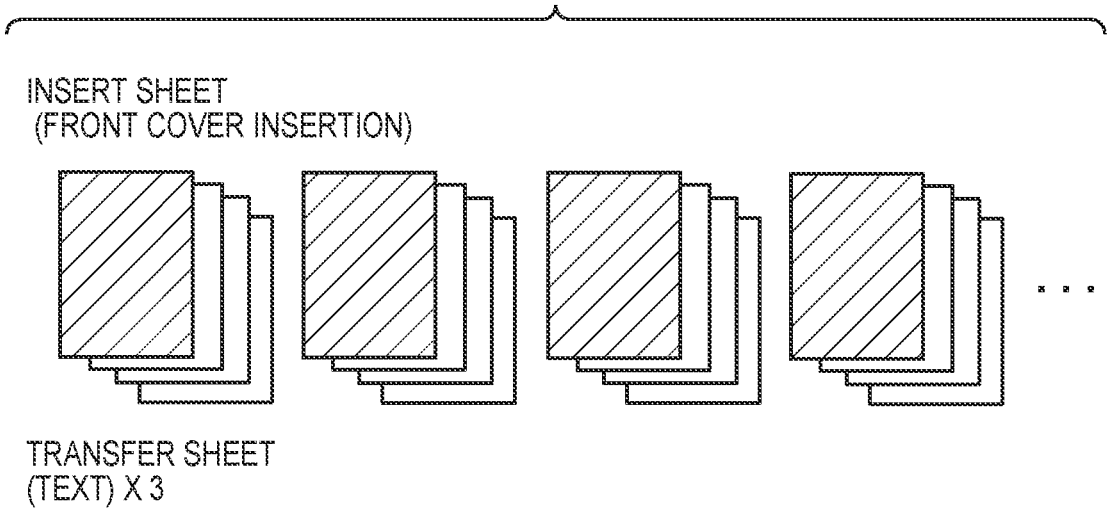
FIG. 4 is a view showing an example of a job in which an insert sheet and transfer sheets are mixed.
Figure 5A:
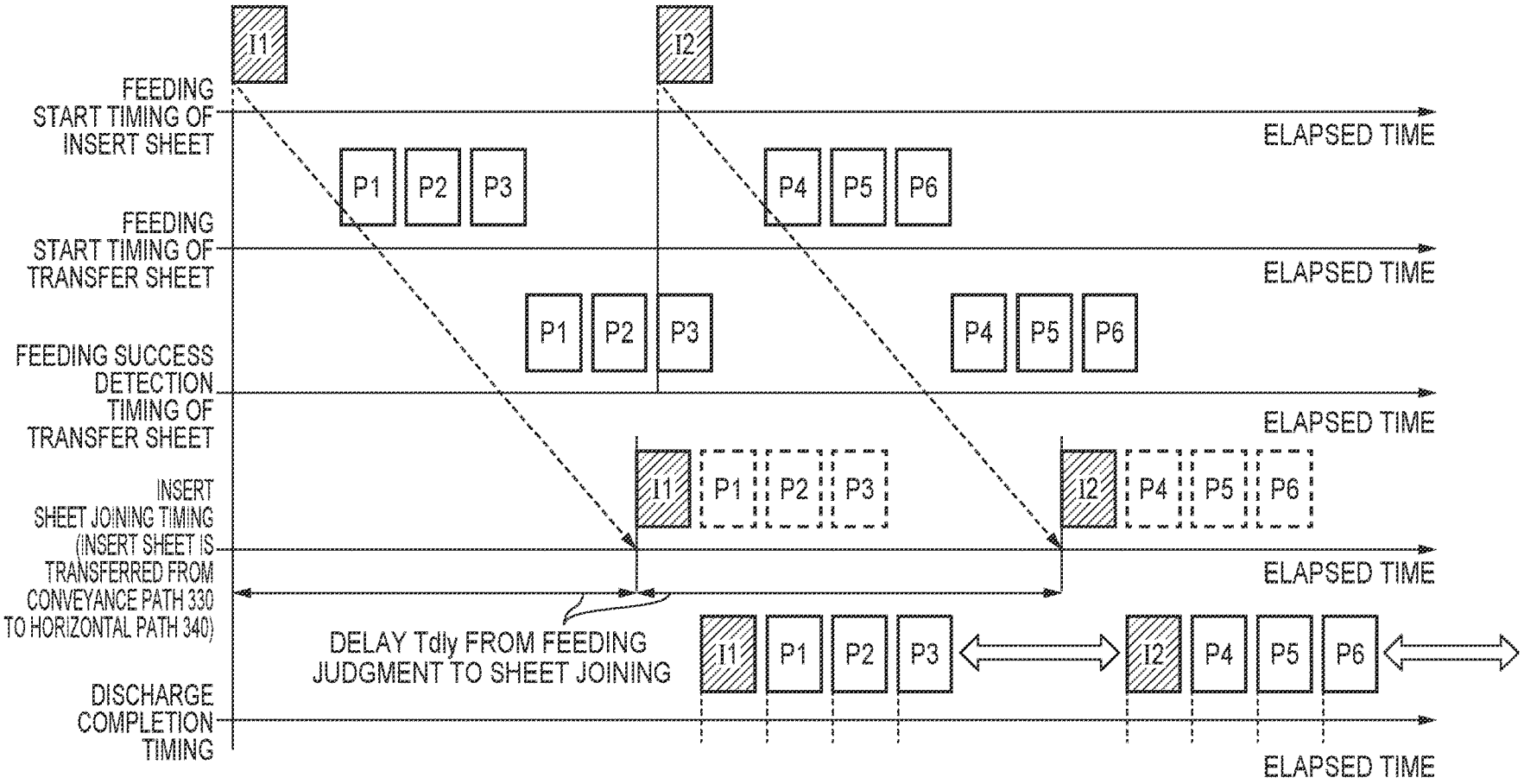
FIG. 5A is a view for explaining feeding start timings in a transfer sheet decision mode.
Figure 5B:
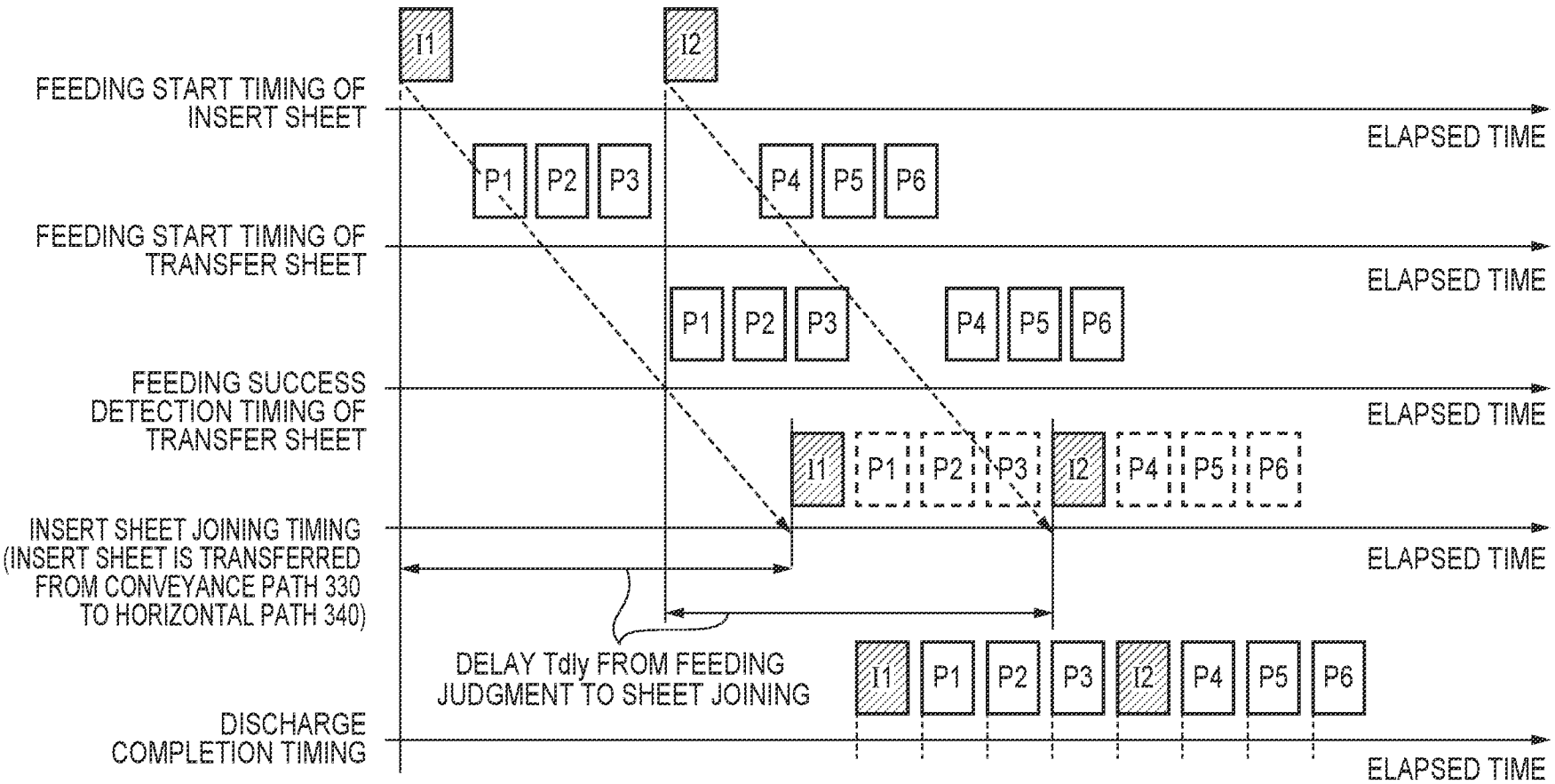
FIG. 5B is a view for explaining feeding start timings in a snap decision mode.

FIG. 4 shows a job in which a plurality of copies each made from a bundle obtained by inserting an insert sheet (front cover) from the insert apparatus 3 onto the uppermost page of three text pages on which single-sided printing has been performed. FIGS. 5A and 5B are views for explaining the insert sheet feeding timings corresponding to the respective modes. The abscissa of each of FIGS. 5A and 5B represents the elapse of time.

FIG. 5A shows the relationship between the feeding start timings of the respective pages of the job in FIG. 4 in the transfer sheet decision mode.

First, the feeding start timing of an insert sheet I1 to be inserted on the uppermost page of the first copy is judged. In this case, since the uppermost sheet has no immediately preceding sheet, feeding is unconditionally possible, that is, the feeding start operation is performed. A time from the start of the feeding operation of the insert sheet I1 to the timing of joining until the horizontal path 340 is set to be Tdly after the start of feeding, including conveyance delays due to the feeding preparation time, the sheet stop/conveyance operation for removing a skewed sheet, and a low conveyance speed of the insert unit with respect to the image forming apparatus 1.

Feeding of a transfer sheet P1 next to the insert sheet I1 is started by back calculation using a timing at which the sheet distance from the insert sheet I1 is shortest. Even if abrupt jam occurs due to the same feeding stage as the transfer sheet P1, the order of the transfer sheets P2 and P3 is not changed in the product. Feeding of the transfer sheets P2 and P3 is continuously started.

Next, judgment of starting feeding an insert sheet I2 to be inserted on the uppermost page of the second copy is necessary. The respective immediately preceding sheets of the transfer sheets P2 and P3 are actually fed, and feeding success cannot be judged until detecting that the trailing edges of the sheets have passed through the feeding sensor 223. That is, since feeding of the transfer sheets P2 and P3 is started in snap decision, feeding the insert sheet I2 cannot be immediately started. Feeding the insert sheet I2 is then started at a timing when the trailing edge of the transfer sheet P3 has passed through the feeding sensor 223.

Judgment of starting feeding the insert sheet inserted on the uppermost sheet from the second or subsequent copy is delayed until the feeding success of the immediately preceding transfer sheet (P3 in the example of FIG. 4) is confirmed. For this reason, the distance from the immediately preceding sheet increases by the delayed feeding start timing, thereby degrading the productivity.

[Insert Sheet Insertion in Snap Decision Mode]

FIG. 5B shows the relationship in the job in FIG. 4 between feeding start timings when control (snap decision mode) is performed so as to insert an insert sheet before the feeding success of a transfer sheet in the snap decision mode.

Feeding for the first copy is performed in the same manner as in the transfer sheet decision mode. The feeding start timing of the insert sheet I2 to be inserted on the uppermost sheet of the second copy is judged to allow feeding in the snap decision even if the feeding success of the immediately preceding transfer sheet P3 is not detected. Feeding is started by back calculation from the timing at which the distance from the transfer sheet P3 is shortest. Note that if the necessary minimum time for feeding the insert sheet I2 after feeding the insert sheet I1 cannot be ensured, feeding the insert sheet I2 is started after the necessary minimum time.

When feeding is performed in snap decision, the productivity for the insert sheet I2 is not degraded because the feeding success of the transfer sheet P3 is not awaited. However, if jam of the transfer sheet P2 or P3 occurs and the insert sheet I2 is discharged, the order of pages of the product becomes wrong.

[Switching Processing Between Transfer Sheet Decision Mode and Snap Decision Mode]

As described above, when feeding control is performed in the snap decision mode, whether feeding from the second or subsequent insert sheet is performed is judged in snap decision. For this reason, if jam of the immediately preceding transfer sheet occurs, the number of remaining sheets during jam increases, thereby degrading jam processability. In this case, if whether jam of the immediately preceding transfer sheet tends to occur can be predicted, the productivity can be increased and the usability can be optimized.

FIG. 6 shows the arrangement example of an accumulation jam count table according to this embodiment. FIG. 6 shows the relationship (statistics) between the sheet attributes (to be referred to as media information hereinafter) set in the feeding stage in the past by the above-mentioned sheet registration operation and the corresponding jam occurrence counts. This statistic information is updated every time a transfer sheet is fed. For example, the statistic information is stored in the RAM 903 of the printer control unit 900. In this embodiment, the accumulation jam count of each medium (shape+surface property) is counted for each basis weight and environment section. The environment sections are classified into three sections as described above, that is, the "LL environment", "NL environment", and "HH environment" based on the temperatures and humidities detected by the temperature/humidity sensor 400.

For example, in the example of FIG. 6, four paper jams of OHP sheets of 151 g to 256 g occurred in the past in all the environment sections. In this embodiment, the accumulation jam count is compared with its switching judgment threshold to judge whether the operation is performed in the transfer sheet decision mode or the snap decision mode. This switching processing will be described in detail later.

Figure 9:
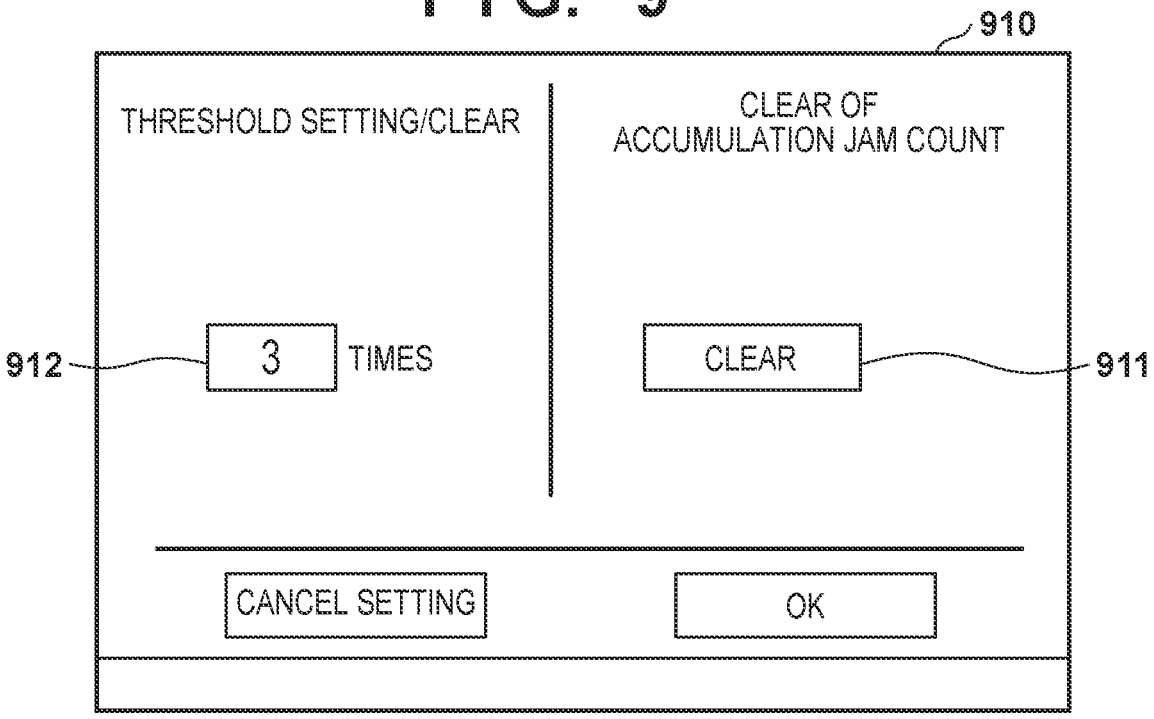
FIG. 9 is a view showing an example of a display screen for clearing the accumulation jam count and the threshold.

The accumulation jam count can be cleared to zero (initialized to zero) by a user operation. For example, when the user presses the application mode key 812 in the initial screen (FIG. 8A) displayed on the user interface 11, the screen shifts to a screen 910 in FIG. 9. When the user presses a clear button 911, the accumulation jam counts of all the media can be cleared. In addition, in the screen 910, the user can change the threshold used for judgment of the feeding control mode using a setting item 912.

(Switching Processing Based on Information of Accumulation Jam Count)

Figure 10A:
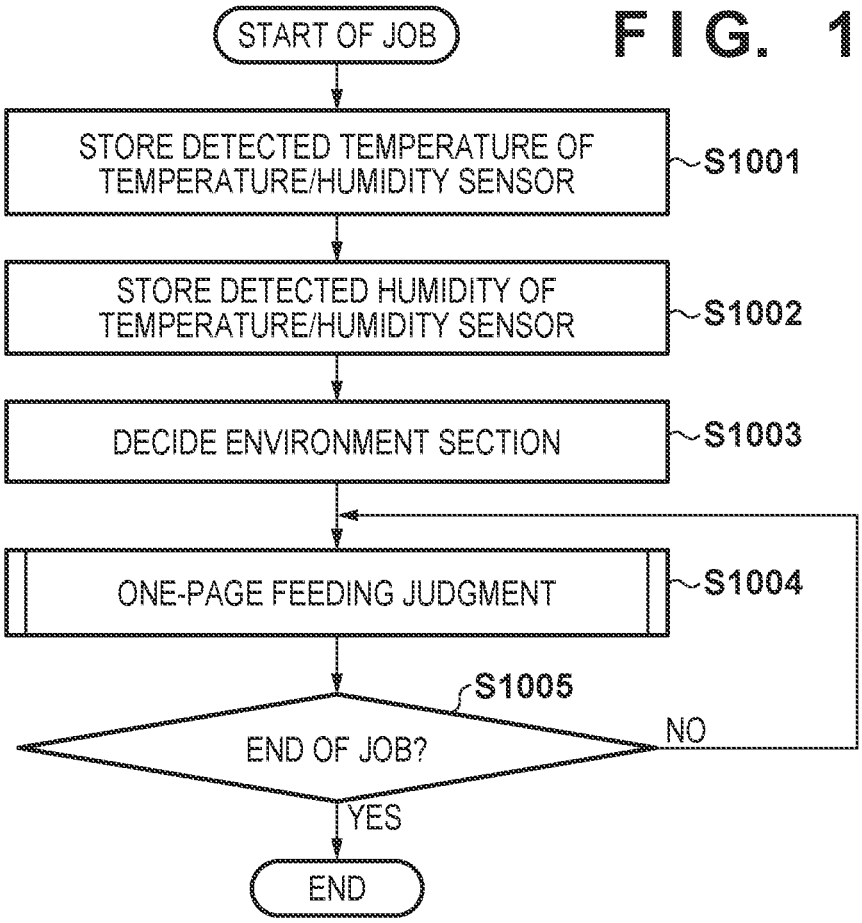
FIGS. 10A and 10B are flowcharts of feeding control mode switching according to the first embodiment.
Figure 10B:
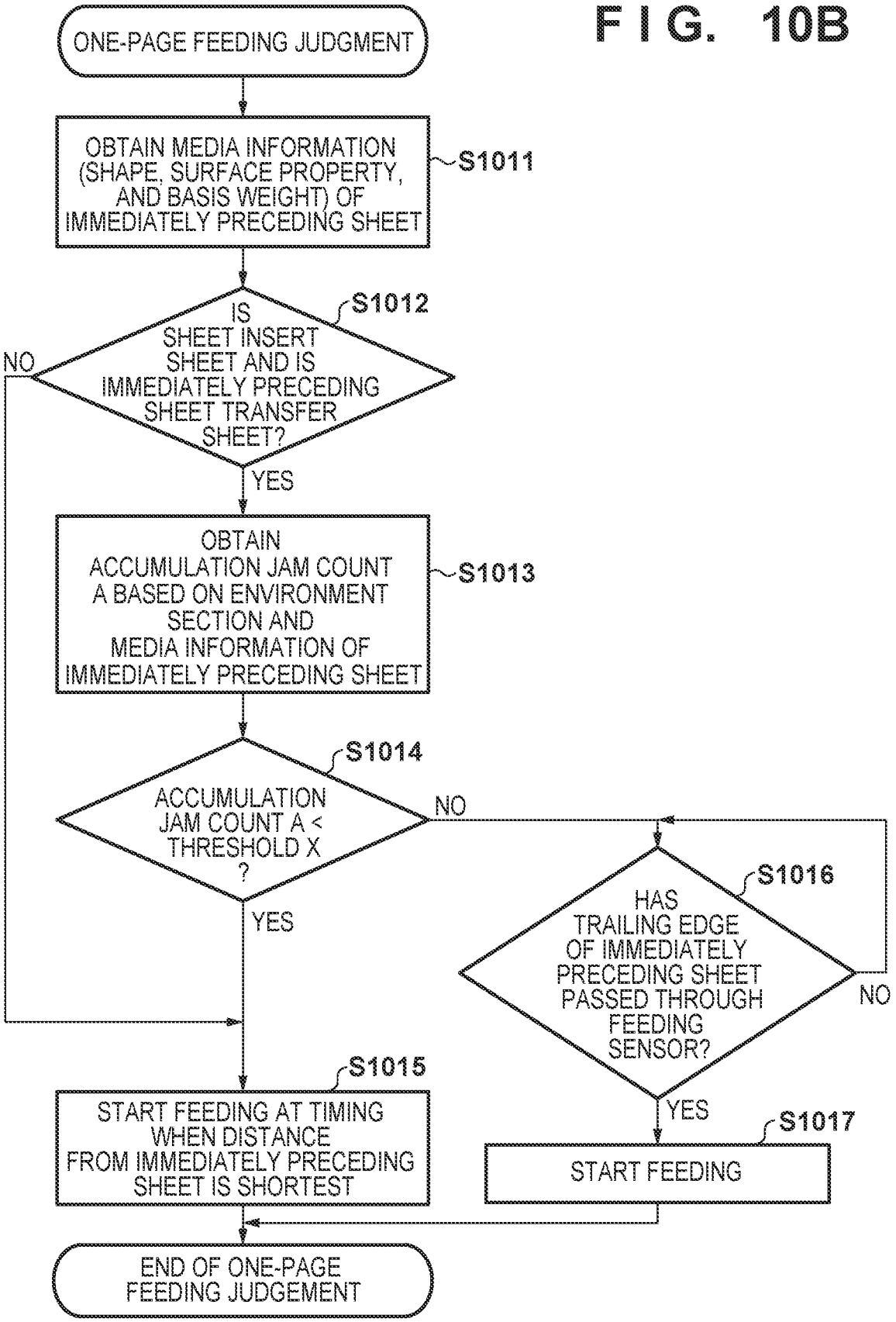

Feeding control mode switching processing by the accumulation jam count according to this embodiment will be described with reference to FIGS. 10A and 10B.

When the job is started, the CPU 901 obtains the environment temperature of the image forming apparatus 1 at the start of the job using the temperature/humidity sensor 400 and stores the environment temperature in the RAM 903 or the like in step S1001.

In step S1002, the CPU 901 obtains the environment humidity of the image forming apparatus 1 at the start of the job using the temperature/humidity sensor 400 and stores the environment humidity in the RAM 903 or the like.

In step S1003, the CPU 901 decides the environment section corresponding to the temperature and humidity at this time. In this embodiment, one of the LL, NL, and HH environments is decided as the environment section.

In step S1004, the CPU 901 determines one-page feeding. Note that in this embodiment, information of each page of the job is queued in the RAM 903, and feeding unit information indicating a specific feeding unit from which a sheet corresponding to this page is included in each page information. For this reason, feeding judgement for each page is performed using the feeding unit information. Details of this processing will be described with reference to FIG. 10B.

In step S1005, after one-page feeding judgement, the CPU 901 determines whether job processing is ended, that is, processing for all the pages included in the job is complete. In this case, the information of unprocessed pages to be processed is queued in the RAM 903. If the job is complete (YES in step S1005), this processing sequence is ended; otherwise (NO in step S1005), the process returns to step S1004 to perform processing for the next unprocessed page.

(One-Page Feeding Judgment Processing)

Details of one-page feeding judgment processing in step S1004 will be described with reference to FIG. 10B.

In step S1011, the CPU 901 reads out the media information of a sheet immediately preceding the sheet to be fed, that is, the immediately preceding sheet from the RAM 903. More specifically, the pieces of information such as the shape, surface property, and basis weight are read out. If the sheet is the first sheet at the start of the job, no immediately preceding sheet is present. In this case, no processing is performed, and the process advances to step S1012.

In step S1012, the CPU 901 determines whether the feeding unit of a sheet to be fed is the feeding tray 320 of the insert apparatus 3, and the feeding unit of the immediately preceding sheet is the paper storage 220. If the above conditions are judged to be satisfied (YES in step S1012), the process advances to step S1013. If the sheet is not an insert sheet or the immediately preceding sheet is not a transfer sheet (NO in step S1012), the process advances to step S1015.

In step S1013, the CPU 901 obtains an accumulation jam count A from the accumulation jam count table (FIG. 6) prestored in the RAM 903 based on the media information (shape, surface property, and basis weight) of the immediate preceding sheet read out in step S1011 and the environment section decided in step S1003.

In step S1014, the CPU 901 compares the accumulation jam count A obtained in step S1013 with the threshold X used in feeding control mode determination. The threshold X is predetermined and held in the ROM 902 or the like. Note that one value may be used as the threshold X or a plurality of values corresponding to a combination of media information and the environment section may be used as the threshold X. If the accumulation jam count A is less than the threshold X (YES in step S1014), the process advances to step S1015. If the accumulation jam count A is the threshold X or more (NO in step S1014), the process advances to step S1016.

In step S1015, the CPU 901 starts feeding by back calculation from the timing at which the distance from the immediately preceding sheet is shortest. That is, it is judged that the immediately preceding sheet has a low feeding jam occurrence probability, and the operation is performed in the snap decision mode in which an insert sheet is fed by the insert apparatus 3 without awaiting the end of feeding of the transfer sheet. This makes it possible to prevent degradation of productivity in the insert sheet mode. This processing sequence is then ended.

In step S1016, the CPU 901 controls to monitor the end of feeding of the immediately preceding sheet. The CPU 901 monitors in step S1016 whether the trailing edge of the immediately preceding sheet has passed through the feeding sensor 223. When feeding of the immediately preceding sheet is complete (YES in step S1016), the process advances to step S1017.

In step S1017, the CPU 901 immediately starts feeding. The monitoring in step S1016 is performed as follows. That is, it is determined that the feeding jam occurrence probability is not low from the past result of the accumulation jam count. Feeding completion of the immediately preceding sheet is awaited, and the transfer sheet decision mode for feeding an insert sheet by the insert apparatus 3 is performed. This makes it possible to prevent the problems that the number of remaining sheets at the time of jam upon occurrence of the jam of the immediately preceding sheet is increased, and the jam processability is degraded. This processing sequence is then ended.

As has been described above, according to this embodiment, the feeding control mode is judged based on the past accumulation jam count and the set media information. Accordingly, when the timing of starting the insertion of the insert sheet is appropriately switched, both the prevention of the degradation of the jam processability and the prevention of the degradation of productivity at the time of feeding the insert sheet are satisfied.

Second Embodiment

In the first embodiment, the feeding control mode is judged with reference to the past accumulation jam count. In the second embodiment of the present invention, the feeding control mode decision control is performed uniquely based on the media information set in a user interface 11. In this case, as media information, brand information of a sheet will be exemplified. Note that the media information according to this embodiment is not limited to the brand information, but can be any information in any form such as the shape, surface property, and basis weight of a sheet if the sheet can be discriminated.

Figures 12, 13A:
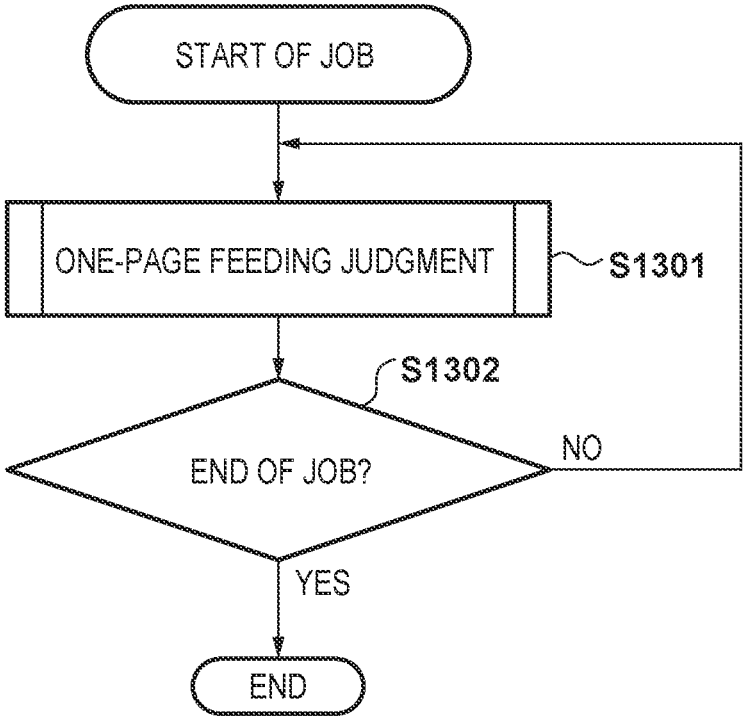
FIG. 12 is a view showing the arrangement example of a brand-feeding control mode correspondence table according to the second embodiment.
FIGS. 13A and 13B are flowcharts of feeding control mode switching according to the second embodiment.

FIG. 12 shows a brand-feeding control mode corresponding table. FIG. 12 shows a list table of brands distributed in the world and the corresponding feeding control modes. This list table is stored in a RAM 903 of a printer control unit 900. In this table, the brands and the feeding control modes are held in association with each other, and these relationships are predetermined.

Figure 11A:
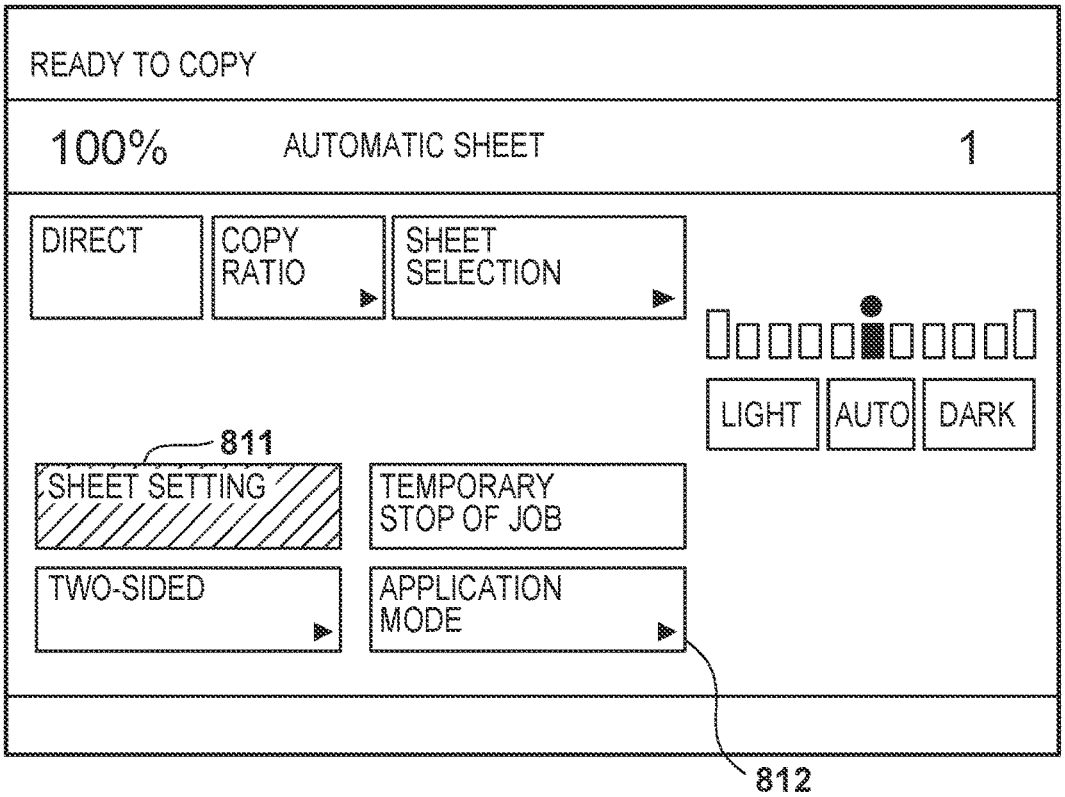
FIGS. 11A, 11B, 11C, and 11D are views for explaining a sheet setting sequence according to the second embodiment.
Figure 11B:
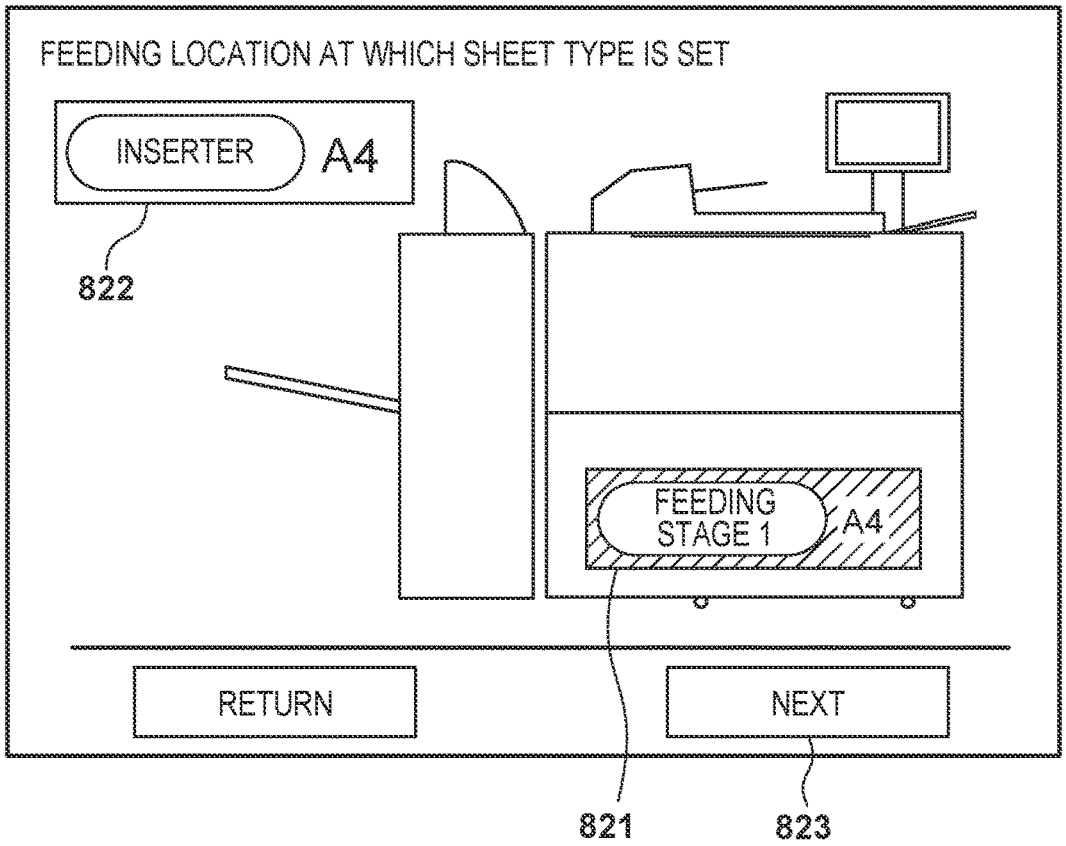
Figure 11C:
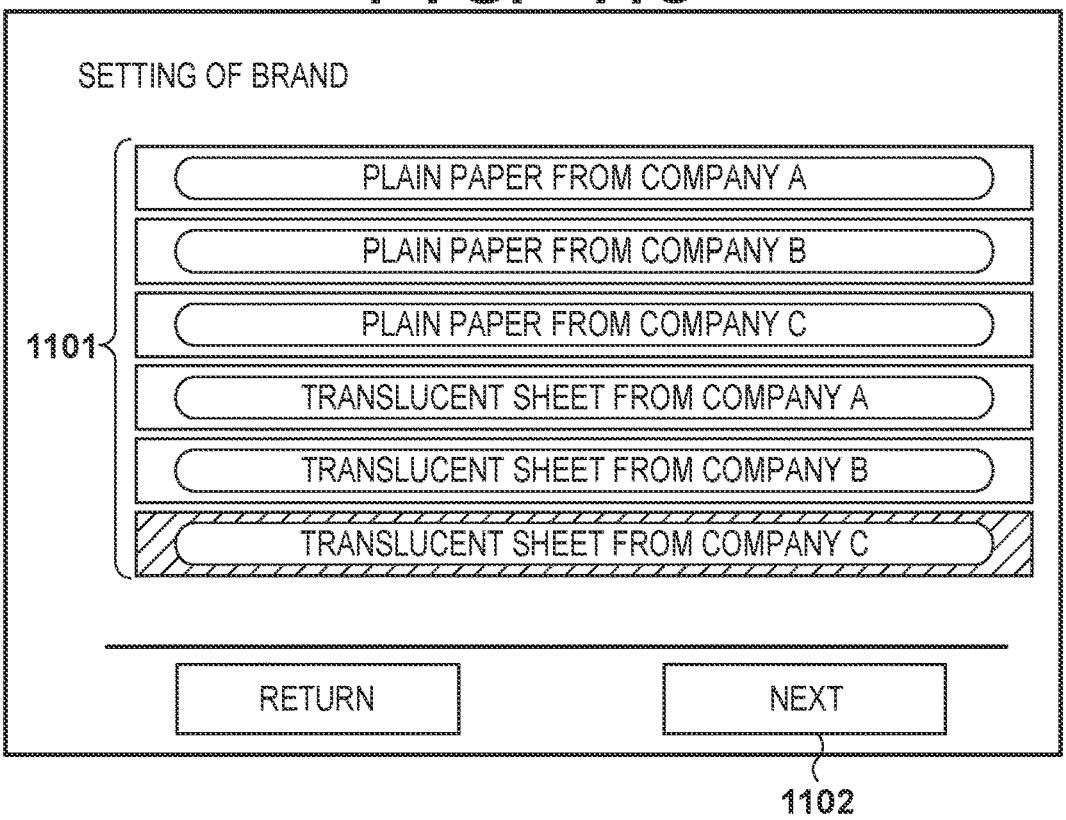
Figure 11D:
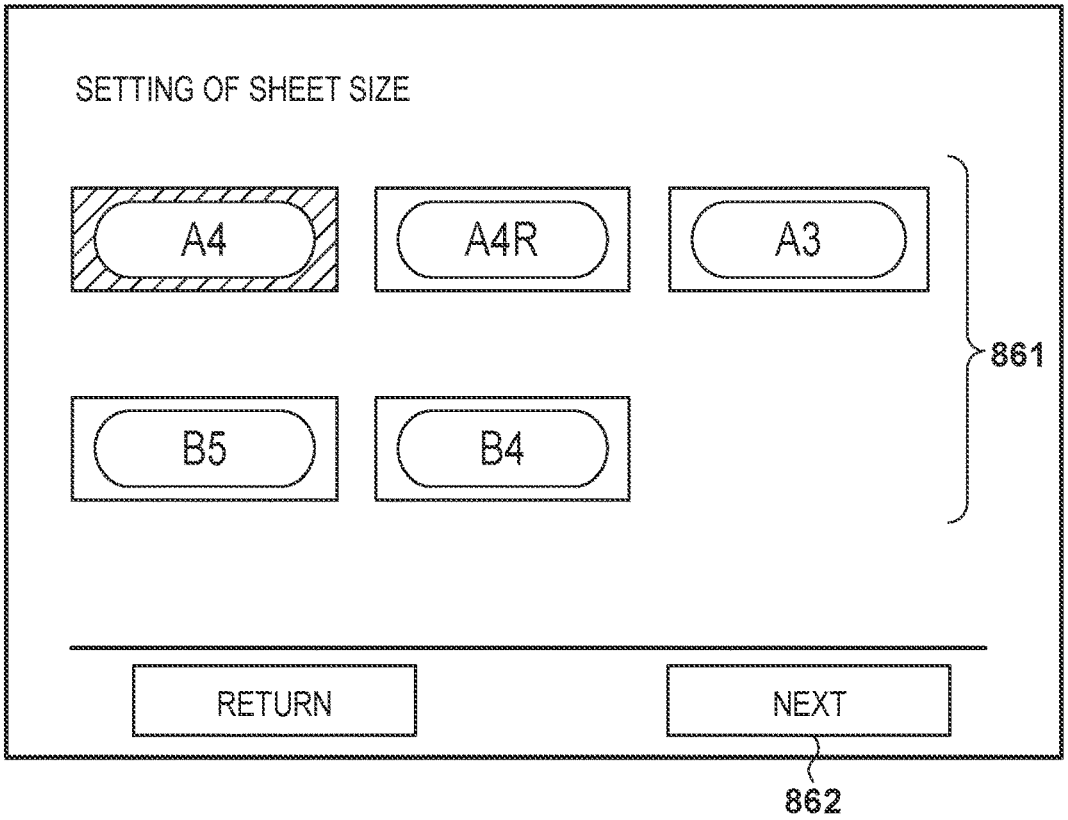

The sequence of a method of setting the brand information of sheets will be described with reference to FIGS. 11A to 11D. FIGS. 11A, 11B, and 11D are similar to FIGS. 8A, 8B, and 8F described in the first embodiment, and a description thereof will be omitted.

In a sheet setting screen in FIG. 11B, assume that selection of a feeding unit 22 (button 821) in which a sheet bundle is set by a user is accepted, and that a "next" button 823 is pressed. When the "next" button 823 is pressed, the screen shifts to a brand setting screen shown in FIG. 11C under the control of a CPU 901.

In the brand setting screen, based on the list shown in FIG. 12, the list of brands commercially available on the market is displayed as buttons 1101. At this time, if brands are many, a maker and a sheet type may be selected by switching the screens in a multi-stage manner. The brand of sheets set in the feeding unit 22 is selected from the buttons 1101, and a "next" button 1102 is pressed. Upon selection of the brand, when the button 1102 is pressed, the screen shifts to a sheet size setting screen shown in FIG. 11D under the control of the CPU 901. When the sheet size is set in the sheet size setting screen, a series of sheet setting operations is complete. Even if the sheet bundle is set in an insert apparatus 3, the sheet setting is performed by the above sequence, thereby ending the sheet registration operation.

[Switching Processing Based on Brand Information]

Feeding control mode switching processing by the sheet brand will be described with reference to FIGS. 13A and 13B.

When the job is started, the CPU 901 performs one-page feeding judgment in step S1301. Details of this processing will be described with reference to FIG. 13B.

After one-page feeding judgment, the CPU 901 determines in step S1302 whether job processing is ended, that is, processing for all pages included in the job is completed. In this case, information of an unprocessed page to be processed is queued in the RAM 903. If the job is complete (YES in step S1302), this processing sequence is ended; otherwise (NO in step S1302), the flow returns to step S1301 to perform processing for the next unprocessed page.

(One-Page Feeding Judgment Processing)

Details of one-page feeding judgment processing in step S1301 will be described using FIG. 13B.

In step S1311, the CPU 901 reads out the sheet brand of a sheet immediately preceding a sheet to be fed, that is, the immediately preceding sheet from the RAM 903. If the sheet is the first sheet at the start of the job, no immediately preceding sheet exists, and no processing is performed. The process then advances to step S1312.

The CPU 901 determines in step S1312 whether the feeding unit for sheets to be fed is a feeding tray 320 of the insert apparatus 3 and the feeding unit of the immediately preceding sheet is a paper storage 220. If it is judged that these conditions are satisfied (YES in step S1312), the process advances to step S1313. If the sheet is not an insert sheet or the immediately preceding sheet is not a transfer sheet (NO in step S1312), the process advances to step S1315.

In step S1313, based on the sheet brand of the immediately preceding sheet read out in step S1311, the CPU 901 obtains feeding control mode information corresponding to the sheet brand from the brand-feeding control mode correspondence table (FIG. 12) prestored in the RAM 903.

In step S1314, the CPU 901 judges the feeding control mode based on the feeding control mode information corresponding to the brand obtained in step S1313. If the feeding control mode is the "snap decision mode" (YES in step S1314), the process advances to step S1315. If the feeding control mode is the "transfer sheet decision mode" (NO in step S1314), the process advances to step S1316.

In step S1315, the CPU 901 starts feeding at a timing when the distance from the immediately preceding sheet is shortest. That is, the CPU 901 judges that the immediately preceding sheet has a low feeding jam occurrence probability, and feeding is performed in the snap decision mode for feeding an insert sheet by the insert apparatus 3 without waiting the end of feeding of the transfer sheet. This makes it possible to prevent the decrease in productivity in the insert sheet mode. This processing sequence is then ended.

In step S1316, the CPU 901 controls to monitor the end of feeding of the immediately preceding sheet. In step S1316, the CPU 901 controls to monitor whether the trailing edge of the immediately preceding sheet has passed through a feeding sensor 223. When feeding of the immediately preceding sheet has been complete (YES in step S1316), the process advances to step S1317.

In step S1317, the CPU 901 immediately starts feeding. The monitoring in step S1316 is performed as follows. That is, it is determined that the feeding jam occurrence probability is not low from the feeding control mode corresponding to the brand. Feeding completion of the immediately preceding sheet is awaited, and the transfer sheet decision mode for feeding an insert sheet by the insert apparatus 3 is performed. This makes it possible to prevent the problems that the number of remaining sheets at the time of j am upon occurrence of the jam of the immediately preceding sheet is increased, and the jam processability is degraded. This processing sequence is then ended.

As described above, according to this embodiment, the feeding control mode associated with the brand in advance is used. Accordingly, when the timing of starting the insertion of the insert sheet is appropriately switched, both the prevention of the degradation of the jam processability and the prevention of the degradation of productivity at the time of feeding the insert sheet are satisfied.

Third Embodiment

[System Arrangement]

Figure 14:
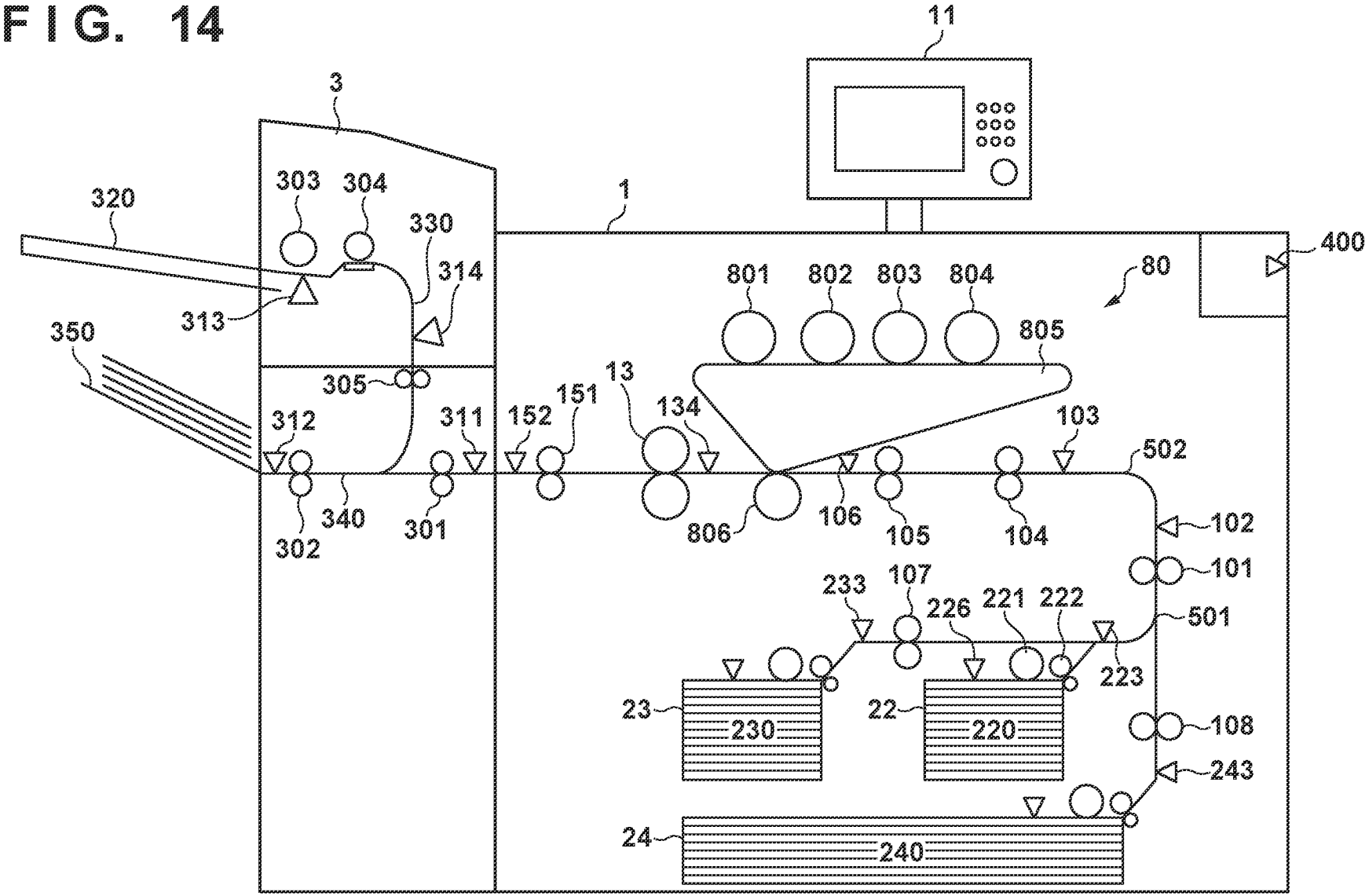
FIG. 14 is a sectional view of an image forming system according to each of the third and fourth embodiments.

FIG. 14 is a view showing the arrangement example of an image forming system according to the third embodiment. As a difference from the arrangement of FIG. 1 described in the first embodiment, the arrangement of the third embodiment includes a plurality of feeding units. Only the difference will be described, and the description of an overlapping portion will be omitted.

Feeding units 23 and 24 shown in FIG. 14 have the same arrangement as a feeding unit 22. The feeding units 23 and 24 confirm using feeding sensors 233 and 243 whether the uppermost sheets are picked up at predetermined timings from the transfer sheets stored in paper storages 230 and 240, respectively.

Figure 15:
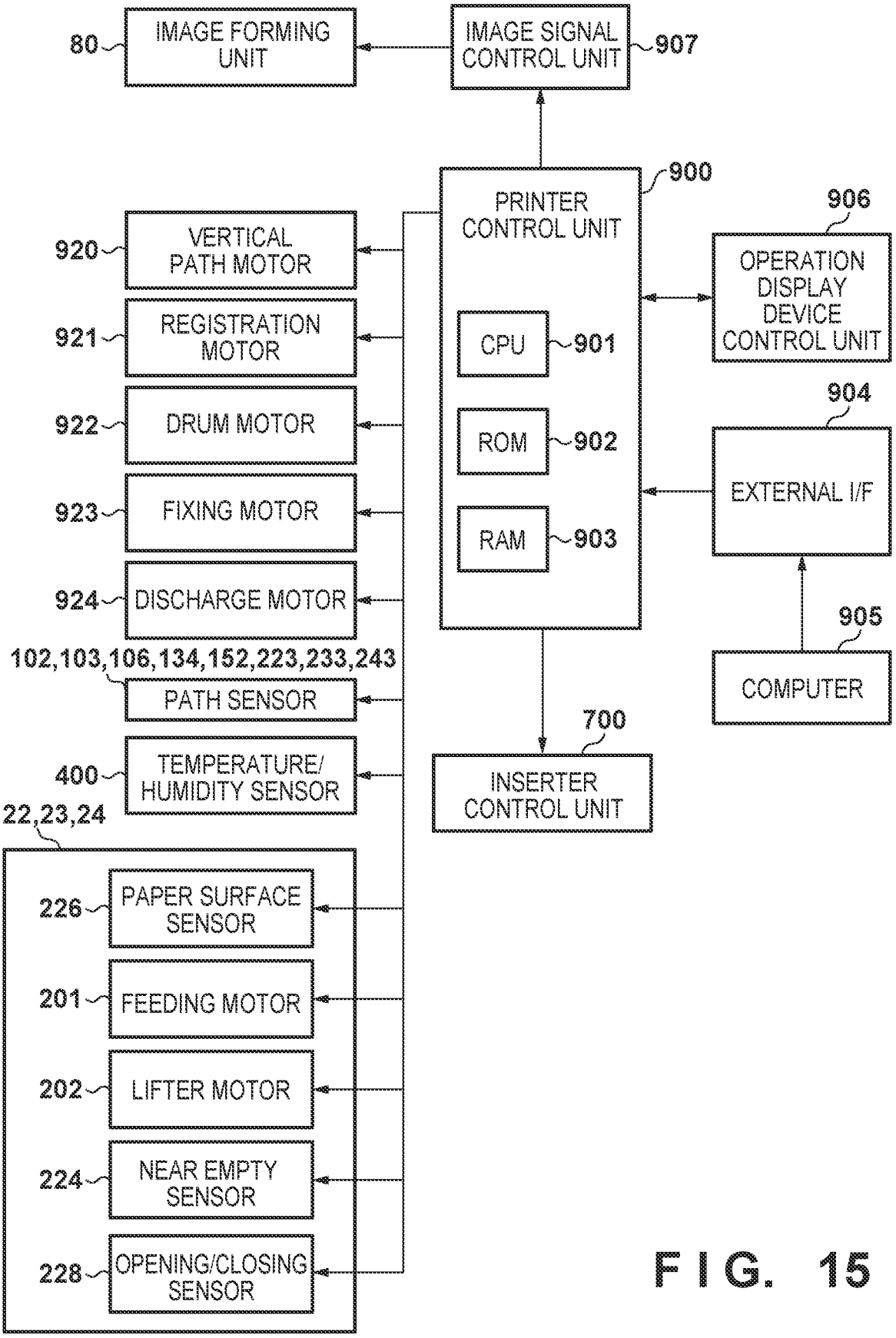
FIG. 15 is a block diagram of the image forming system according to each of the third and fourth embodiments.

FIG. 15 is a view showing the arrangement of a controller for controlling the entire image forming system and its peripheral arrangement according to this embodiment. Only the difference from the arrangement of FIG. 2 described in the first embodiment will be described, and the description of the overlapping portion will be omitted.

As drive sources from the plurality of feeding units 22, 23, and 24 shown in FIG. 14 to a vertical path 501, the image forming system includes a feeding motor 201 for driving a pickup roller 221, and a vertical path motor 920 for driving feeding rollers 222, vertical path rollers 101 and 108, and conveyance rollers 107.

Each of the feeding units 22, 23, and 24 includes a near empty sensor 224 for detecting that the remaining amount of transfer sheets placed on the corresponding one of the paper storages 230 and 240 and a paper storage 220 is smaller than a predetermined amount. Each of the feeding units 22, 23, and 24 includes an opening/closing sensor 228 for detecting the opening/closing of the corresponding one of the paper storages 220, 230, and 240. In addition, detection sensors such as path sensors 102, 103, 106, 134, 152, and 223, and the path sensors 233 and 243 are arranged to detect the passage of sheets.

[Switching Processing between Transfer Sheet Decision Mode and Snap Decision Mode]

FIG. 16 shows feeding history information according to this embodiment. FIG. 16 shows that the latest feeding statuses in the plurality of feeding stages are held as feeding history information. The feeding history information corresponding to each feeding stage is stored in a RAM 903 of a printer control unit 900. As the latest feeding status for each feeding stage, if feeding of an immediately preceding stored transfer sheet is successful, the status is managed as "success"; if feeding of the immediately preceding stored transfer sheet fails, the status is managed as "failure"; and if no feeding is performed from a timing when the paper storage 220 is opened and closed to store new transfer sheets, the status is managed as "not feed". Note that the statuses held as the feeding history information are not limited to the above statuses, but other statuses may be used.

(Switching Processing Based on Feeding History Information)

Figure 17:
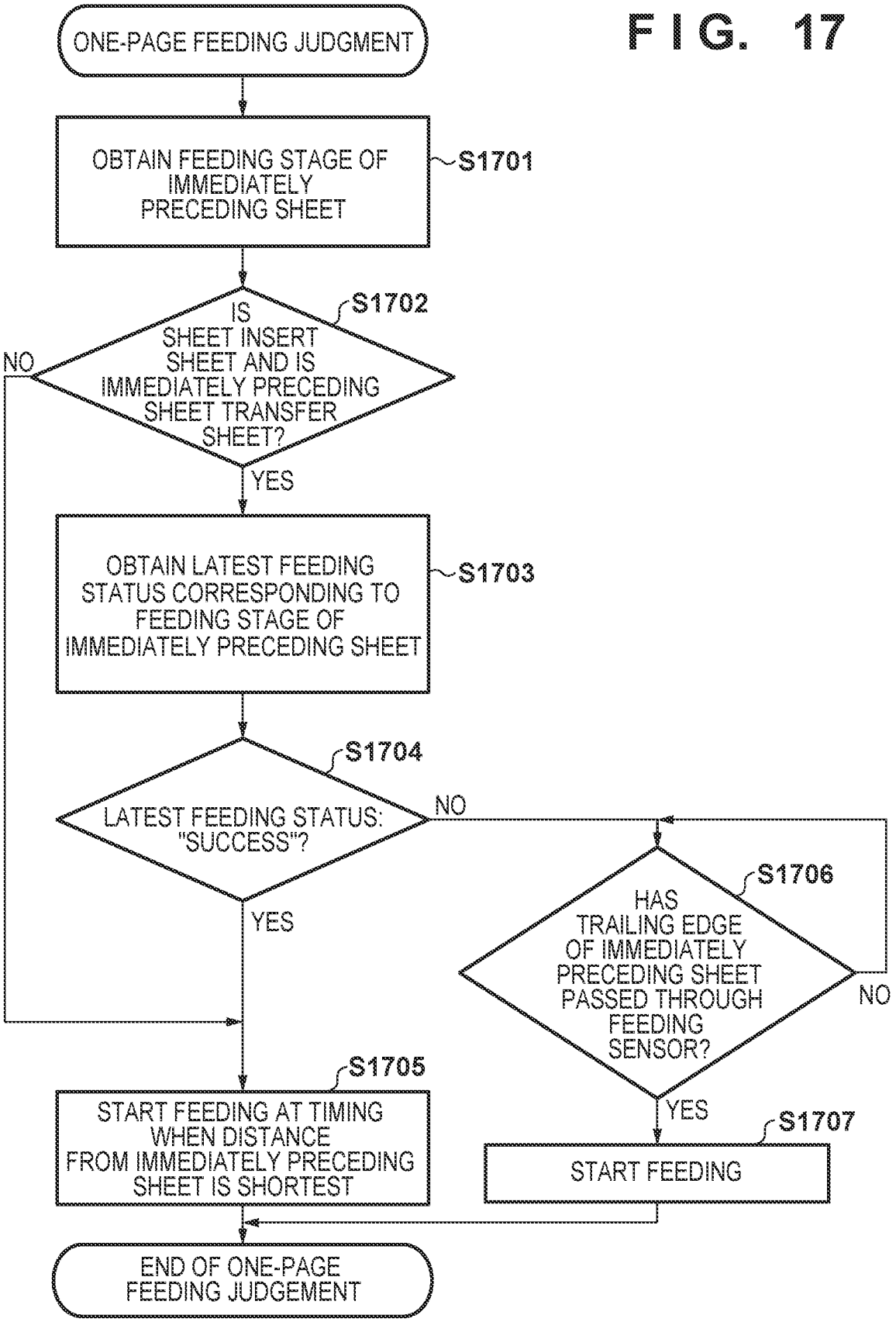
FIG. 17 is a flowchart of one-page feeding judgment processing according to the third embodiment.

Feeding control mode switching processing by the feeding history information according to this embodiment will be described with reference to FIG. 17.

Figure 13B:
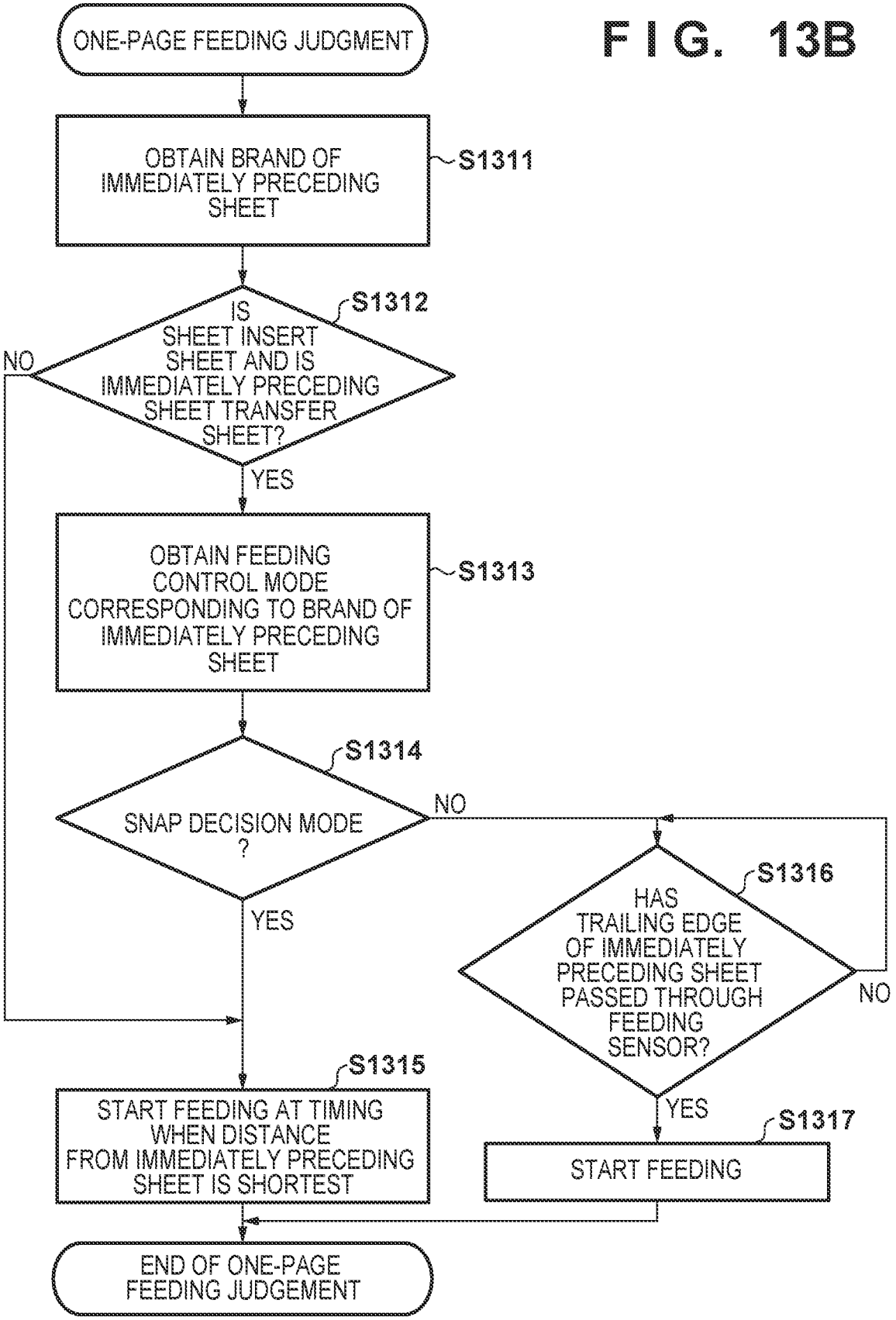

When the job is started, the same processing as in FIGS. 13A and 13B described in the second embodiment is performed. In one-page feeding judgment in step S1301, processing shown in FIG. 17 is executed.

In step S1701, a CPU 901 reads out the feeding stage of a sheet immediately preceding a sheet to be fed, that is, the immediately preceding sheet from the RAM 903. If the sheet is the first sheet at the start of the job, no immediately preceding sheet exists, and no processing is performed. The process advances to step S1702.

The CPU 901 determines in step S1702 whether the feeding unit of the sheet to be fed is a feeding tray 320 of an insert apparatus 3 and the feeding unit of the immediately preceding sheet is a transfer sheet feeding stage such as each of the paper storages 220, 230, and 240. If the above conditions are judged to be satisfied (YES in step S1702), the process advances to step S1703. If the sheet is not an insert sheet or the immediately preceding sheet is not a transfer sheet (NO in step S1702), the process advances to step S1705.

In step S1703, the CPU 901 obtains the corresponding latest feeding status from the feeding history information stored in the RAM 903, based on the feeding stage of the immediately preceding sheet read out in step S1701.

In step S1704, the CPU 901 judges the feeding control mode based on the latest feeding status of the feeding stage obtained in step S1703. In this case, the CPU 901 determines whether the latest feeding status is "success". If the latest feeding status is "success" (YES in step S1704), the process advances to step S1705. If the latest feeding status is a status except "success" (NO in step S1704), the process advances to step S1706. The status except "success" can be "failure" or "not feed".

In step S1705, the CPU 901 starts feeding by back calculation from the timing at which the distance from the immediately preceding sheet is shortest. That is, it is judged that the immediately preceding sheet has a low feeding jam occurrence probability, and the operation is performed in the snap decision mode in which an insert sheet is fed by the insert apparatus 3 without awaiting the end of feeding of the transfer sheet. This makes it possible to prevent degradation of productivity in the insert sheet mode. This processing sequence is then ended.

In step S1706, the CPU 901 controls to monitor the end of feeding of the immediately preceding sheet. The CPU 901 monitors in step S1706 whether the trailing edge of the immediately preceding sheet has passed through each of the feeding sensors 223, 233, and 243. When feeding of the immediately preceding sheet is complete (YES in step S1706), the process advances to step S1707.

In step S1707, the CPU 901 immediately starts feeding. The monitoring in step S1706 is performed as follows. That is, it is determined that the feeding jam occurrence probability is not low from the latest feeding status. Feeding completion of the immediately preceding sheet is awaited, and the transfer sheet decision mode for feeding an insert sheet by the insert apparatus 3 is performed. This makes it possible to prevent the problems that the number of remaining sheets at the time of jam upon occurrence of the jam of the immediately preceding sheet is increased, and the jam processability is degraded. This processing sequence is then ended.

As has been described above, according to this embodiment, the feeding control mode is judged based on the feeding history information of the feeding stage of the immediately preceding sheet. Accordingly, when the timing of starting the insertion of the insert sheet is appropriately switched, both the prevention of the degradation of the jam processability and the prevention of the degradation of productivity at the time of feeding the insert sheet are satisfied.

Fourth Embodiment

In the third embodiment, the feeding control mode is judged in accordance with the latest feeding status of the feeding stage. In the fourth embodiment of the present invention, feeding control mode judgment control is performed in accordance with a success count of feeding from the feeding stage. Note that the arrangement examples in FIGS. 14 and 15 described in the third embodiments are used in the fourth embodiment, and a description thereof will be omitted.

FIG. 18 shows feeding history information according to this embodiment. Referring to FIG. 18, each of a plurality of feeding stages holds, as feeding history information, a feeding success counter as the number of times feeding of the transfer sheet is successful. The feeding success counter is updated every time a transfer sheet is fed. The feeding history information corresponding to each feeding stage is stored in a RAM 903 of a printer control unit 900. The feeding success counter is managed for each feeding stage. If feeding of the transfer sheet is successful, the counter is counted up. If feeding fails due to feeding jam or the like, and the paper storage is opened and closed to perform jam processing or replenish it with transfer sheets, the counter is cleared (initialized to zero).

(Switching Processing Based on Feeding History Information)

Figure 19A:
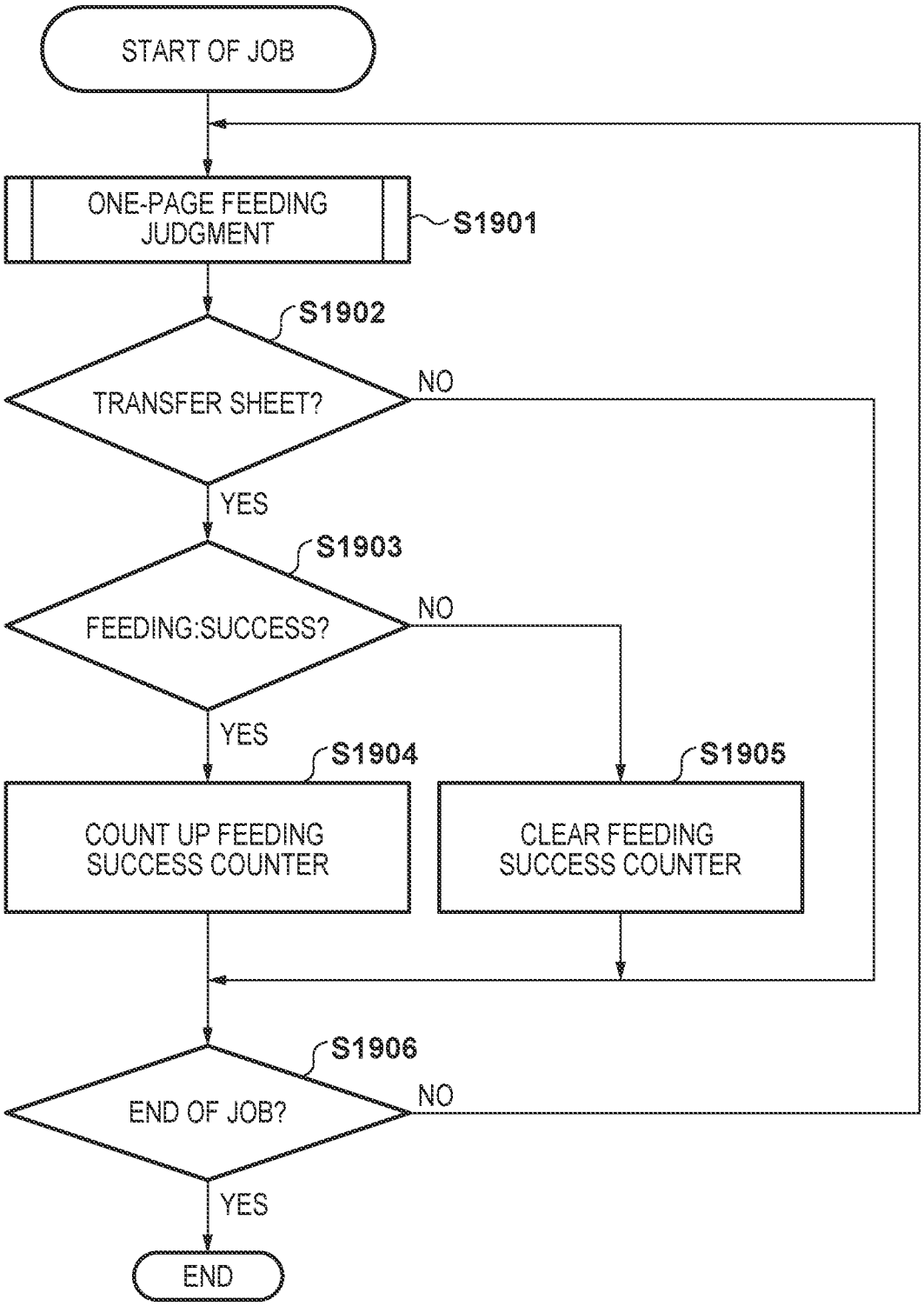
FIGS. 19A and 19B are flowcharts of feeding control mode switching according to the fourth embodiment.

Feeding control mode switching processing by feeding history information according to this embodiment will be described with reference to FIGS. 19A and 19B.

When the job is started, a CPU 901 performs one-page feeding judgment in step S1901. Details of processing of this step will be described with reference to FIG. 19B.

The CPU 901 determines in step S1902 whether the feeding unit of this page is a transfer sheet feeding stage such as each of paper storages 220, 230, and 240. If the feeding unit is judged to be the transfer sheet feeding stage (YES in step S1902), the process advances to step S1903; otherwise (NO in step S1902), the process advances to step S1906.

The CPU 901 judges in step S1903 whether feeding of this page is successful. If feeding is successful (YES in step S1903), the process advances to step S1904; otherwise (NO in step S1903), the process advances to step S1905.

In step S1904, the CPU 901 increments the feeding success counter of the corresponding feeding stage by one, and the process advances to step S1906.

In step S1905, the CPU 901 clears the feeding success counter of the corresponding feeding stage, and the process advances to step S1906.

The CPU 901 determines in step S1906 whether after one-page feeding judgment, the job processing is ended, that is, processing for all the pages included in the job is complete. In this case, the information of unprocessed pages to be processed is queued in the RAM 903. If the job is complete (YES in step S1906), this processing sequence is ended; otherwise (NO in step S1906), the process returns to step S1901 to perform processing for the next unprocessed page.

(One-Page Feeding Judgment Processing)

Details of one-page feeding judgment processing in step S1901 will be described with reference to FIG. 19B.

In step S1911, the CPU 901 reads out from the RAM 903 the feeding stage of the immediately preceding sheet of a sheet to be fed. When the sheet is the first sheet at the start of the job, no immediately preceding sheet exists, and no processing is performed. The process advances to step S1912.

In step S1912, the CPU 901 determines whether the feeding unit of a sheet to be fed is a feeding tray 320 of an insert apparatus 3, and the feeding unit of the immediately preceding sheet is the corresponding one of the paper storages 220, 230, and 240. If the above conditions are judged to be satisfied (YES in step S1912), the process advances to step S1913. If the sheet is not an insert sheet or the immediately preceding sheet is not a transfer sheet (NO in step S1912), the process advances to step S1915.

In step S1913, based on the feeding stage of the immediately preceding sheet read out in step S1911, the CPU 901 obtains the corresponding feeding success counter value A from the feeding history information stored in the RAM 903.

In step S1914, the CPU 901 judges the feeding control mode. In this case, the feeding success counter value A is compared with a predetermined threshold X. A value for judging that feeding jam has occurred is defined as the threshold X and held in a ROM 902 or the like. Note that one value may be used as the threshold X, or a plurality of values defined for the respective feeding stages may be used. If the feeding success counter value A is larger than the threshold X (YES in step S1914), the process advances to step S1915. If the feeding counter value A is smaller than the threshold X (NO in step S1914), the process advances to step S1916.

In step S1915, the CPU 901 starts feeding by back calculation from a timing at which the distance from the immediately preceding sheet is shortest. That is, it is judged that the immediately preceding sheet has a low feeding jam occurrence probability, and the operation is performed in the snap decision mode in which an insert sheet is fed by the insert apparatus 3 without waiting the end of feeding of the transfer sheet. This makes it possible to prevent degradation of productivity in the insert sheet mode. This processing sequence is then ended.

In step S1916, the CPU 901 controls to monitor the end of feeding of the immediately preceding sheet. The CPU 901 monitors in step S1916 whether the trailing edge of the immediately preceding sheet has passed through the corresponding one of feeding sensors 223, 233, and 243. When feeding of the immediately preceding sheet is complete (YES in step S1916), the process advances to step S1917.

In step S1917, the CPU 901 immediately starts feeding. The monitoring in step S1916 is performed as follows. That is, it is determined that the feeding jam occurrence probability is not low from the feeding success counter value A. Feeding completion of the immediately preceding sheet is awaited, and the transfer sheet decision mode for feeding an insert sheet by the insert apparatus 3 is performed. This makes it possible to prevent the problems that the number of remaining sheets at the time of jam upon occurrence of the jam of the immediately preceding sheet is increased, and the jam processability is degraded. This processing sequence is then ended.

(Clear Processing of Feeding Success Counter)

In the arrangement of this embodiment, even if a job is not executed, processing for clearing the feeding success counter is performed in consideration of a case in which the feeding jam occurrence probability becomes high. The clearing timing is, for example, a case in which the paper storage is opened and closed to replenish paper storages 220, 230, and 240 with transfer sheets, a case in which the registered media information is changed for each feeding unit, or a case in which the environment condition of each feeding unit is changed.

Figure 20:
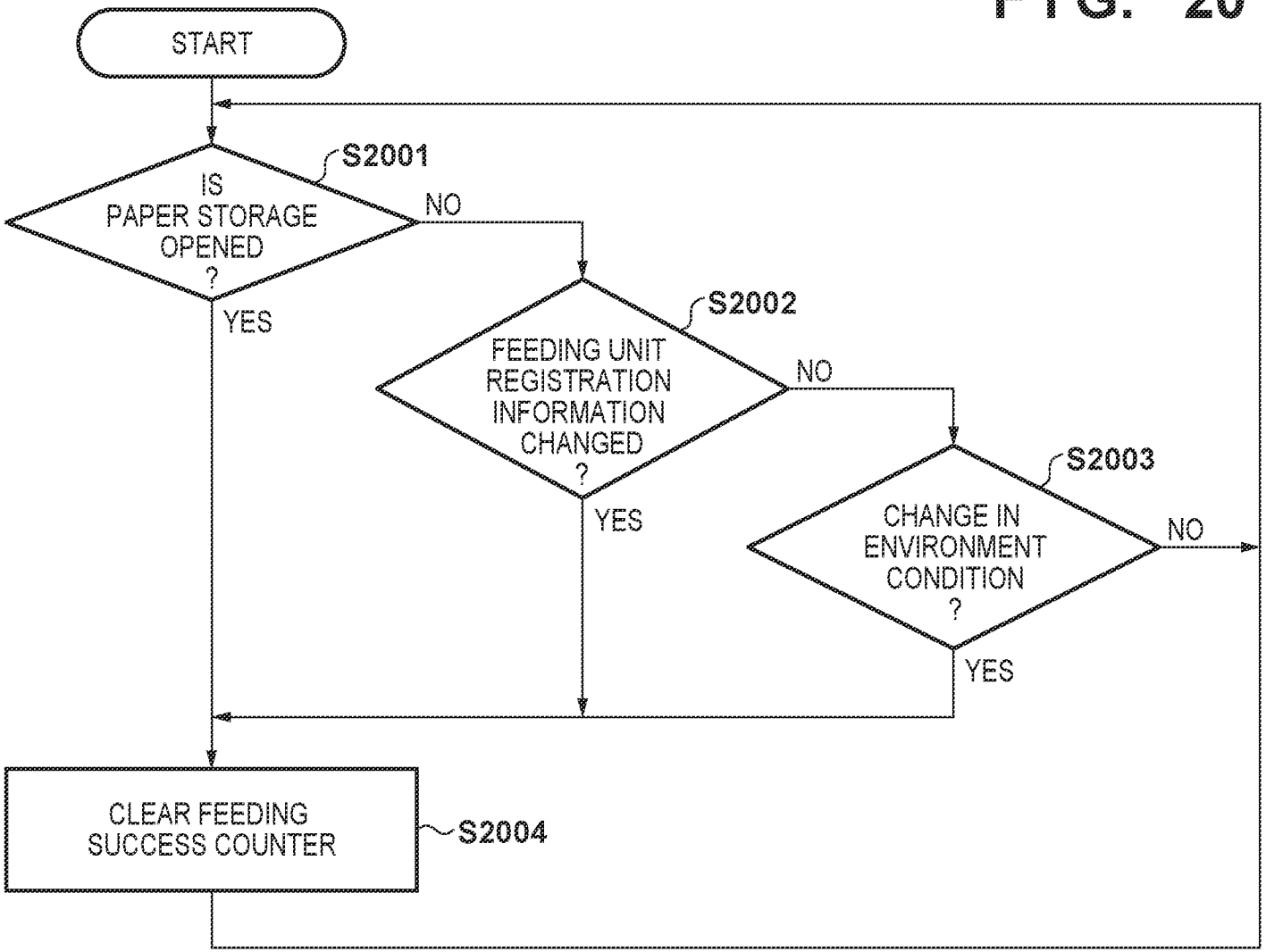
FIG. 20 is a flowchart of counter clear processing according to the fourth embodiment.

Processing for clearing the feeding success counter will be described with reference to FIG. 20. This processing sequence is appropriately executed by the CPU 901 from the power-on of an image forming apparatus 1 to its power-off.

The CPU 901 judges in step S2001 whether the paper storages 220, 230, and 240 are opened. Whether each paper storage is opened is detected by an input signal from an opening/closing sensor 228 arranged in each paper storage. If each paper storage is opened (YES in step S2001), the process advances to step S2004; otherwise (NO in step S2001), the process advances to step S2002.

The CPU 901 judges in step S2002 whether the registration information of each feeding unit is changed. The change in the registration information of each feeding unit is performed as described with reference to FIGS. 8A to 8F in the first embodiment. If the registration information of each feeding unit is changed (YES in step S2002), the process advances to step S2004; otherwise (NO in step S2002), the process advances to step S2003.

The CPU 901 judges in step S2003 whether the environment condition of each feeding unit is changed. The change in environment condition of each feeding unit is, for example, a change in the environment section around the apparatus, that is, LL, NL, or HH environment section determined based on the temperature and humidity around the apparatus, which is detected by a temperature/humidity sensor 400. If the environment section of each feeding unit is changed (YES in step S2003), the process advances to step S2004; otherwise (NO in step S2003), the process returns to step S2001, and the same processing as described above is subsequently performed. Note that the environment sections are held as histories of the sections at given time and changes in sections by detecting the surroundings of the apparatus at, for example, a predetermined interval.

As described above, even if a job is not executed and if the feeding jam occurrence probability may be increased due to user's operations and changes in environment conditions, the feeding success counter can be cleared.

In addition, the feeding success counter may be cleared upon power-on in consideration of a case in which the feeding jam occurrence probability may be increased, for example, when the power of the image forming apparatus is kept off. The processing in FIG. 20 may be performed for each feeding stage.

As described above, according to this embodiment, the feeding control mode is judged based on the feeding history information. Accordingly, when the timing of starting the insertion of the insert sheet is appropriately switched, both the prevention of the degradation of the jam processability and the prevention of the degradation of productivity at the time of feeding the insert sheet are satisfied.

Figure 19B:
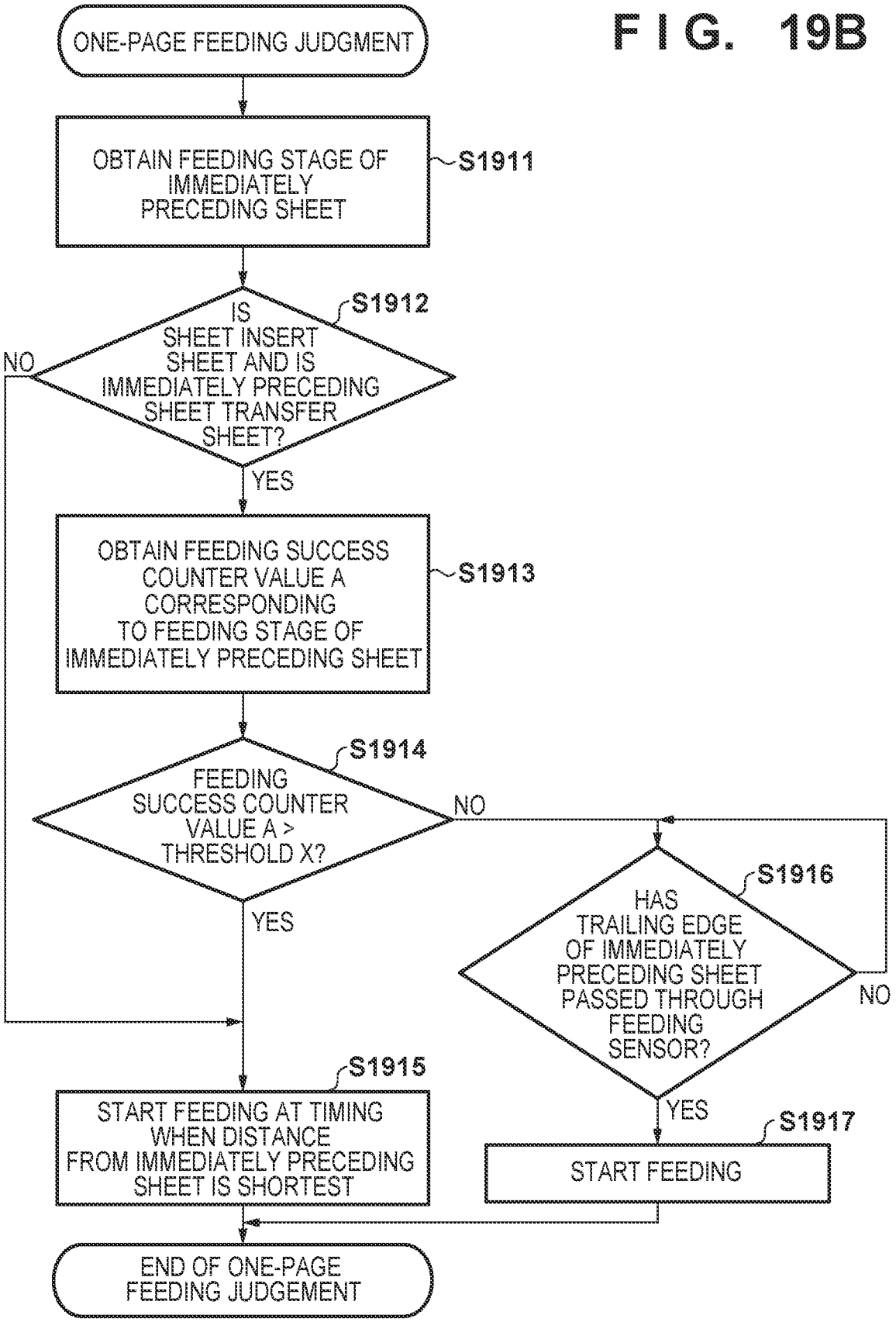

Note that in step S1905 of FIG. 19B, the operation of clearing the feeding success counter is performed. However, the present invention is not limited to this. A counter corresponding to the feeding failure may be arranged, and this counter may be counted up. Alternatively, control may be performed in accordance with a count at the time of failure, or one-page feeding judgment control may be performed in accordance with the count of continuous successes/failures.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-154730, filed Aug. 9, 2017, which is hereby incorporated by reference herein in its entirety.

What is claimed is:

1. An image forming system comprising:

a storage unit configured to store a first recording medium and a second recording medium;

an image forming unit configured to form images on the first and second recording mediums conveyed from the storage unit along a conveyance path;

an insert unit, comprising a feeding tray on which an insert sheet is placed, configured to feed the insert sheet from the feeding tray and configured to insert the insert sheet between the first recording medium and the second recording medium conveyed from the image forming unit;

an input unit configured to input information indicating a type of the first recording medium stored in the storage unit; and a control unit configured to control a feeding timing of the insert sheet by the insert unit based on the type of the first recording medium indicated by the information inputted by the input unit; and a detecting unit configured to detect a recording medium conveyed along the conveyance path, wherein the feeding timing of the insert sheet includes:

a first timing at which feeding of the insert sheet by the insert unit is started after the first recording medium is detected by the detecting unit, and a second timing at which feeding of the insert sheet by the insert unit is started before the first recording medium is detected by the detecting unit.

2. The system according to claim 1, wherein the type of the first recording medium includes a surface property of the first recording medium.

3. The system according to claim 1, wherein the input unit is configured to accept setting of an attribute of the recording medium.

4. The system according to claim 1, further comprising a temperature/humidity detection unit configured to detect one of a temperature and a humidity of surroundings of the image forming system, wherein the control unit is configured to control the feeding timing of the insert sheet by the insert unit based on information of surroundings detected by the temperature/humidity detection unit at the time of feeding the insert sheet by the insert unit and the type of the first recording medium indicated by the information input by the input unit.

5. The system according to claim 1, further comprising a memory configured to store a feeding success count corresponding to the first recording medium, wherein the control unit is configured to control the feeding timing of the insert sheet by the insert unit based on the feeding success count stored in the memory.

6. The system according to claim 5, wherein the feeding success count is initialized when a predetermined condition is satisfied.

7. The system according to claim 6, wherein the predetermined condition includes one of a case in which feeding fails, a case in which the storage unit is opened and closed, a case in which a type of recording medium to be fed is changed, a case in which an environment of surroundings of the image forming system is changed, and a case in which the image forming system is powered on.

8. A non-transitory computer-readable storage medium storing a program for use with an image forming system including:

a storage unit configured to store a first recording medium and a second recording medium;

an image forming unit configured to form images on the first and second recording mediums conveyed from the storage unit along a conveyance path;

an insert unit, comprising a feeding tray on which an insert sheet is placed, configured to feed the insert sheet from the feeding tray and configured to insert the insert sheet between the first recording medium and the second recording medium conveyed from the image forming unit;

an input unit configured to input information indicating a type of the first recording medium stored in the storage unit; and a detecting unit configured to detect a recording medium conveyed along the conveyance path, the program causing the image forming system to function to control a feeding timing of the insert sheet by the insert unit based on the type of the first recording medium indicated by the information inputted by the input unit, wherein the feeding timing of the insert sheet includes:

a first timing at which feeding of the insert sheet by the insert unit is started after the first recording medium is detected by the detecting unit, and a second timing at which feeding of the insert sheet by the insert unit is started before the first recording medium is detected by the detecting unit.

9. The system according to claim 1, wherein the type of the first recording medium includes a shape of the first recording medium.

10. The system according to claim 1, wherein the type of the first recording medium includes a basis weight of the first recording medium.

11. The system according to claim 1, wherein the type of the first recording medium includes brand information of the first recording medium.

12. The system according to claim 1, further comprising:

a first conveyance path along which the first and second recording mediums with the images formed thereon by the image forming unit are conveyed, and a second conveyance path along which the insert sheet fed from the feeding tray is conveyed, the second conveyance path joining the first conveyance path, wherein a conveyance speed of the insert sheet conveyed along the second conveyance path is lower than a conveyance speed of a recording medium conveyed along the first conveyance path.

* * * * *